US012610999B2

(12) United States Patent
Ngo et al.

(10) Patent No.: US 12,610,999 B2
(45) Date of Patent: Apr. 28, 2026

(54) HEADWEAR WITH TWO-PART DEPLOYABLE CAPE

(71) Applicant: Sunday Afternoons, Inc., Talent, OR (US)

(72) Inventors: Tu Ngo, Long beach, CA (US); James Stinson, Prairie Village, KS (US); Claire Bunch, Medford, OR (US)

(73) Assignee: SUNDAY AFTERNOONS, INC., Talent, OR (US)

( * ) Notice: Subject to any disclaimer, the term of this patent is extended or adjusted under 35 U.S.C. 154(b) by 0 days.

(21) Appl. No.: 18/820,077

(22) Filed: Aug. 29, 2024

(65) Prior Publication Data

US 2025/0072543 A1 Mar. 6, 2025

Related U.S. Application Data

(60) Provisional application No. 63/579,497, filed on Aug. 29, 2023.

(51) Int. Cl.

| | |
|---|---|
| ***A42B 1/0186*** | (2021.01) |
| ***A42B 1/0182*** | (2021.01) |
| ***A42B 1/241*** | (2021.01) |
| ***A42B 1/247*** | (2021.01) |

(52) U.S. Cl.

CPC ..... *A42B 1/0186* (2021.01); *A42B 1/0182* (2021.01); *A42B 1/241* (2013.01); *A42B 1/247* (2013.01)

(58) Field of Classification Search

CPC ..... A42B 1/0186; A42B 1/0187; A42B 1/241; A42B 1/247

See application file for complete search history.

(56) References Cited

U.S. PATENT DOCUMENTS 1,008,425 A * 11/1911 Miller ..... A42B 1/06 2/172
1,352,968 A * 9/1920 Josephs ..... A42B 1/0188 2/172
2,275,693 A * 3/1942 Soboroff ..... A42B 1/0186 2/209.12
2,615,168 A * 10/1952 Springer ..... A42B 1/241 2/209.3
2,676,325 A * 4/1954 Carlson ..... A42B 1/0188 2/172
2,743,454 A * 5/1956 Woodbury ..... A42B 1/0188 2/172
2,897,510 A * 8/1959 Christin ..... A42B 1/06 2/172
4,064,562 A * 12/1977 Kenny ..... A42B 1/006 2/84

(Continued)

FOREIGN PATENT DOCUMENTS

DE 4040442 A1 * 6/1992 ..... A42B 1/06
KR 20240043968 A * 4/2024 ..... A42B 1/0182

*Primary Examiner* — Heather Mangine
(74) *Attorney, Agent, or Firm* — McCoy Russell LLP

(57) ABSTRACT

Systems are provided for headwear including a first pocket positioned on a first side of the headwear and a second pocket positioned on a second side of the headwear, where the second side is opposite the first side. The headwear further includes a set of capes including a first cape housed in and deployable from the first pocket and a second cape housed in and deployable from the second pocket.

16 Claims, 12 Drawing Sheets

(56) References Cited

U.S. PATENT DOCUMENTS 4,451,935 A * 6/1984 Henschel ..... A42B 1/241 2/253
5,367,713 A * 11/1994 McCallum ..... A42B 1/006 2/209.12
5,649,327 A * 7/1997 Crewe ..... A42B 1/0187 2/172
5,694,648 A * 12/1997 Nucifora ..... A42B 1/0186 2/172
5,729,830 A * 3/1998 Luhtala ..... F41H 1/00 2/200.1
5,860,165 A * 1/1999 Cvijanovich ..... A42B 1/0186 2/172
5,894,604 A * 4/1999 Crabb ..... A42B 1/241 2/209.13
6,079,052 A * 6/2000 Veridiano ..... A42B 1/0182 2/172
6,131,201 A * 10/2000 Chu ..... A42B 1/0187 2/172
6,247,177 B1 * 6/2001 Hayes ..... A61F 9/029 2/209.13
6,317,892 B1 * 11/2001 Galigani ..... A42B 1/241 2/209.12
6,966,072 B1 * 11/2005 Kobayashi ..... A42B 1/0187 2/209.13
D599,533 S * 9/2009 Yun ..... D2/879
D617,083 S * 6/2010 Yun ..... D2/886
10,342,276 B2 * 7/2019 Buri ..... A42B 1/0187
10,609,977 B1 * 4/2020 Stir ..... A42B 1/206
11,771,161 B2 * 10/2023 Nakamura ..... A42B 1/04 2/171.2
D1,036,815 S * 7/2024 Robinson ..... D2/882
2001/0016958 A1 * 8/2001 Linday ..... A42B 1/0187 2/200.1
2003/0088904 A1 * 5/2003 Taguchi ..... A42B 1/206 2/171
2003/0106134 A1 * 6/2003 Kim ..... A42B 1/0186 2/171
2005/0188449 A1 * 9/2005 Larson ..... A42B 1/0182 2/209.11
2006/0005300 A1 * 1/2006 St-Germain ..... A42B 1/0182 2/209.13
2006/0021110 A1 * 2/2006 Lunzer ..... A42B 1/06 2/209.11
2006/0168708 A1 * 8/2006 Moshier ..... A42B 1/0182 2/175.6
2006/0174398 A1 * 8/2006 Proctor ..... A42B 1/22 2/209.13
2007/0245458 A1 * 10/2007 McGee ..... A42B 1/06 2/195.3
2008/0016602 A1 * 1/2008 Baldwin ..... A42B 1/241 2/209.12
2011/0107500 A1 * 5/2011 Wathen ..... A42B 1/0187 2/209.13
2013/0326791 A1 * 12/2013 Woo ..... A42B 1/0187 2/172
2014/0189933 A1 * 7/2014 Toronto ..... A42B 1/0187 2/172
2014/0298567 A1 * 10/2014 Potts ..... A42B 1/008 2/171.2
2016/0374420 A1 12/2016 Woo
2017/0035135 A1 * 2/2017 Gimena ..... A42B 1/241
2017/0208887 A1 * 7/2017 Rubenstein ..... A42B 1/0186
2017/0216099 A1 * 8/2017 Saladino ..... A42B 1/247
2018/0199650 A1 * 7/2018 Kim ..... A63B 57/10
2019/0021429 A1 * 1/2019 Diez De Sollano Díaz ..... A42B 1/241
2019/0306612 A1 * 10/2019 Washburn ..... H04R 1/1058
2019/0353463 A1 * 11/2019 Saad ..... A42B 1/205
2020/0229527 A1 * 7/2020 Henning ..... A42B 1/02
2021/0161236 A1 * 6/2021 Antunes ..... A42B 1/012
2021/0177082 A1 * 6/2021 Watson, Jr. ..... A42B 1/247
2021/0259346 A1 * 8/2021 Hodgdon ..... A42B 1/22
2022/0061443 A1 * 3/2022 Kountz ..... A42B 1/22
2022/0130362 A1 * 4/2022 Washburn ..... H04R 1/1008
2022/0192306 A1 * 6/2022 An ..... A41D 13/1161
2022/0346482 A1 * 11/2022 Hodgdon ..... A42B 1/0186
2022/0346483 A1 * 11/2022 McDonald ..... A42B 1/247
2022/0378137 A1 * 12/2022 Hayes ..... A42B 1/049
2023/0320447 A1 * 10/2023 Kim ..... A42B 1/205 2/209.11
2025/0072543 A1 * 3/2025 Ngo ..... A42B 1/247

* cited by examiner

HEADWEAR WITH TWO-PART DEPLOYABLE CAPE

RELATED APPLICATIONS

The present application claims priority to U.S. Provisional Application No. 63/579,497, entitled "HEADWEAR WITH TWO-PART DEPLOYABLE CAPE," and filed Aug. 29, 2023, the entire contents of which is hereby incorporated by reference for all purposes.

FIELD

The disclosure relates to a headwear, and more specifically to a headwear including a two-part deployable cape.

BACKGROUND

Headwear may be utilized to shield a wearer from environmental hazards, such as sunlight, debris, rain, etc. In some cases, it may be desirable for headwear to shield more than a head of a wearer. As such, some headwear may include a cape that extends from the headwear to cover at least a portion of the neck of the wearer. During some conditions and/or activities, a wearer may desire to temporarily stow the cape away.

SUMMARY

The disclosure provides embodiments of headwear that mitigate the above-described issues. For example, headwear according to the following disclosure may include a first pocket positioned on a first side of the headwear and a second pocket positioned on a second side of the headwear where the second side is opposite the first side. The headwear further includes a set of capes including a first cape housed in and deployable from the first pocket and a second cape housed in and deployable from the second pocket. In some examples, the first cape is configured to extend from the first side of the headwear to a rear of the headwear and the second cape is configured to extend from the second side of the headwear to the rear of the headwear. Further, in some examples, the headwear further comprises one or more fasteners configured to couple the first cape to the second cape.

BRIEF DESCRIPTION OF THE DRAWINGS

The disclosure may be better understood from reading the following description of non-limiting embodiments, with reference to the attached drawings, wherein below.

DETAILED DESCRIPTION

Figure 1:
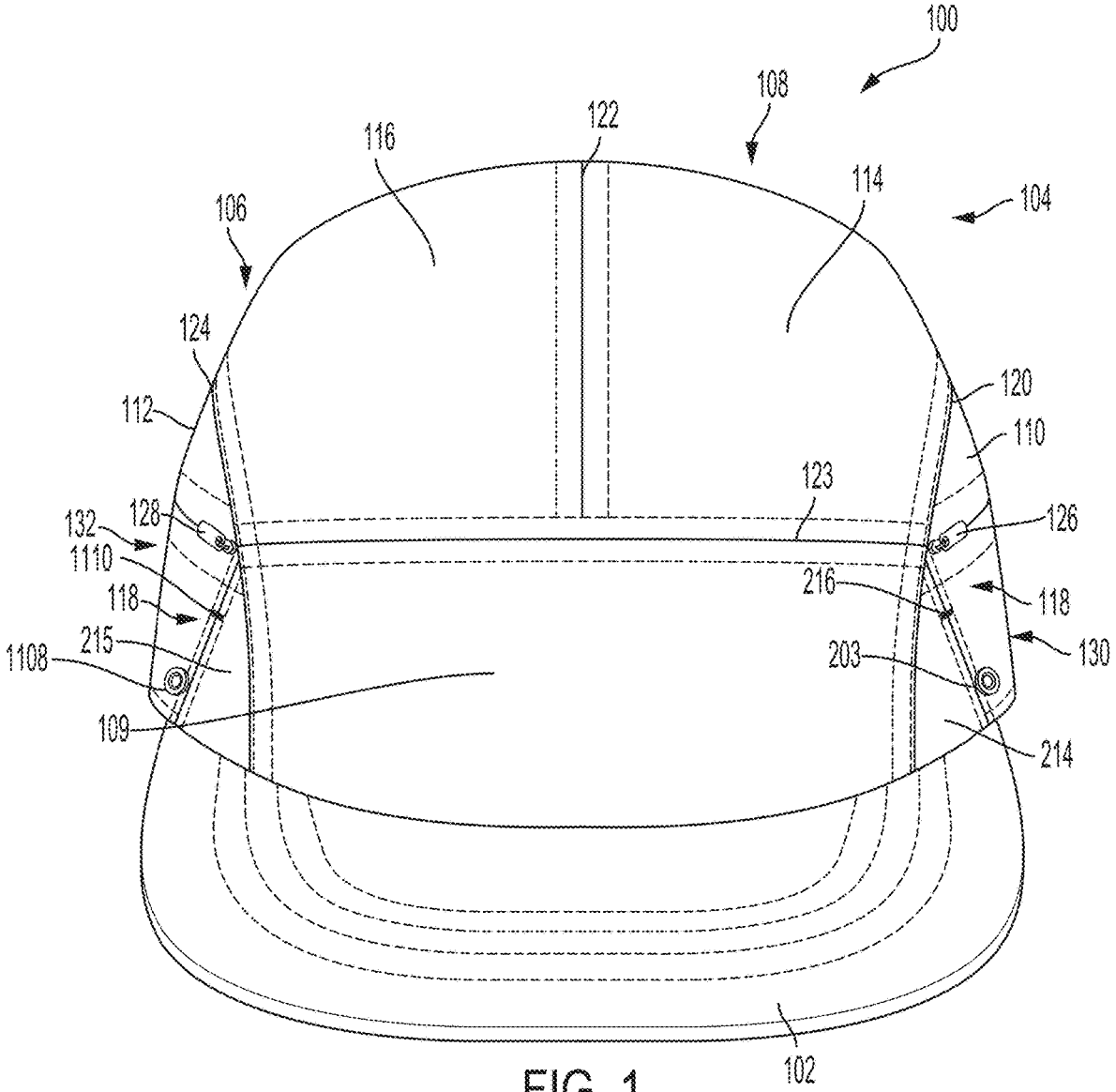
FIG. 1 shows a front view of an example headwear including a two-part deployable cape, with each cape of the two-part deployable cape in a stowed position, in accordance with one or more embodiments of the present disclosure.
Figure 2:
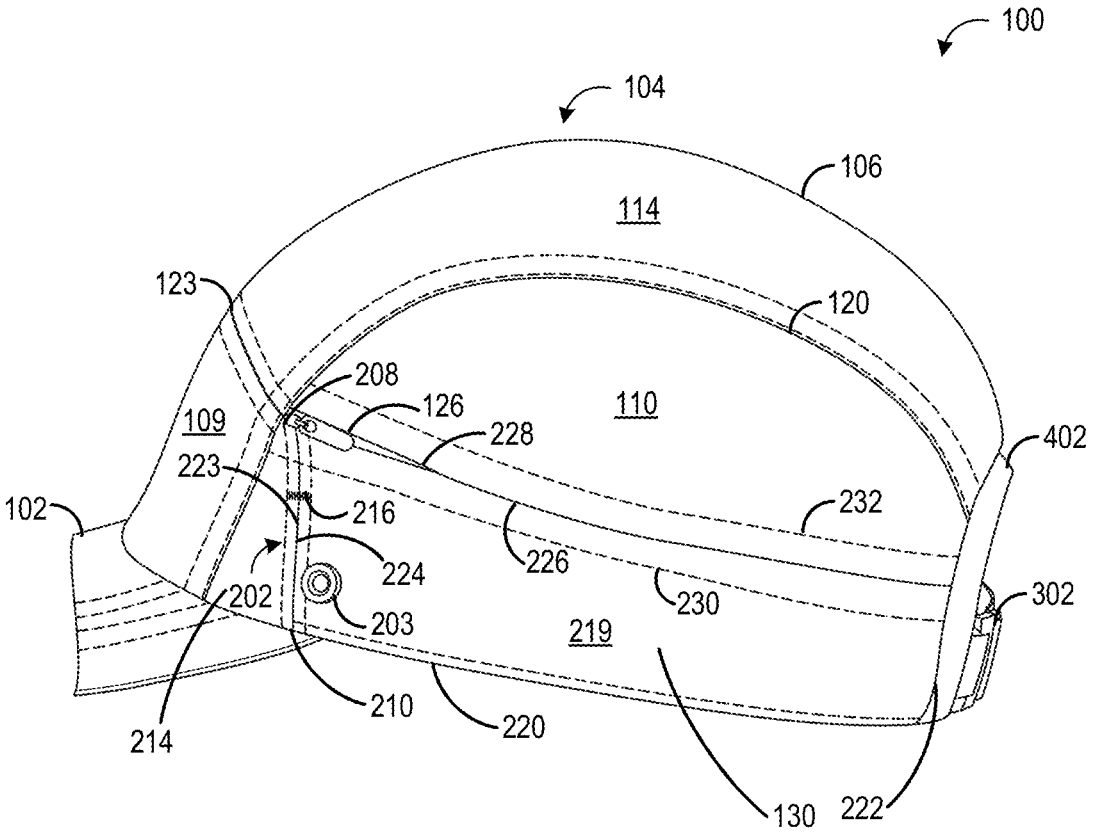
FIG. 2 shows left side view of the example headwear of FIG. 1.
Figure 3:
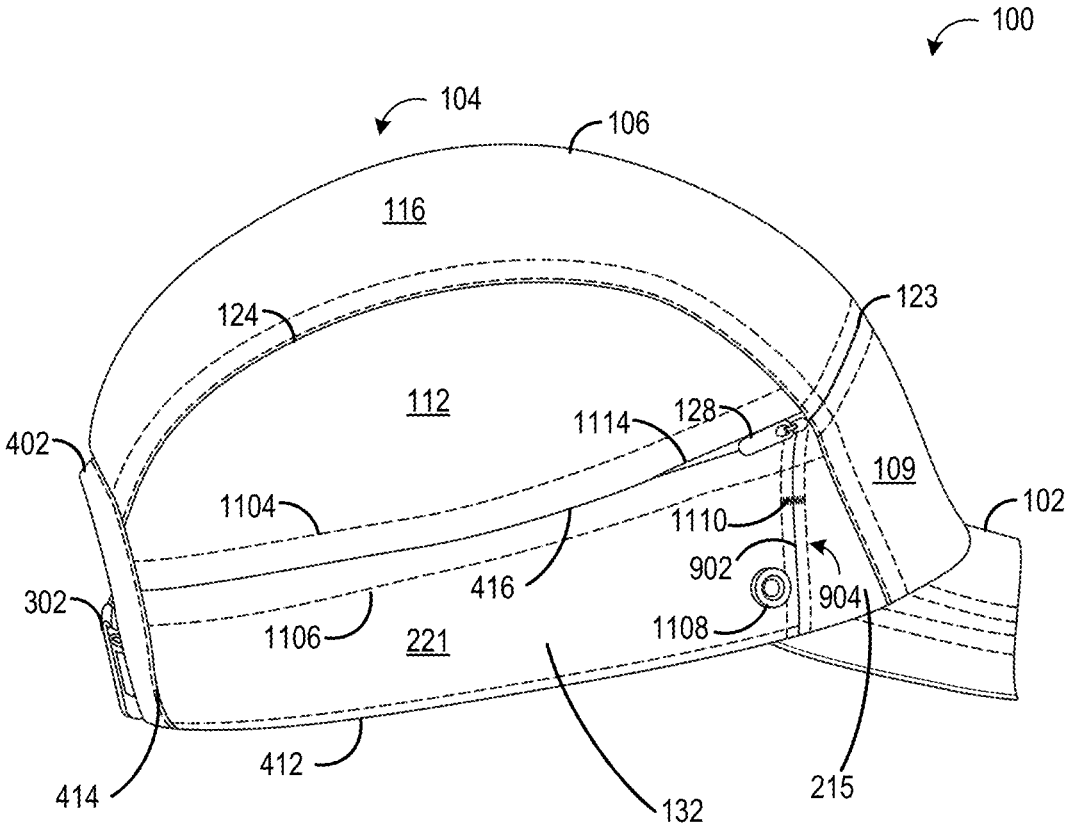
FIG. 3 shows a right side view of the example headwear of FIG. 1.
Figure 4:
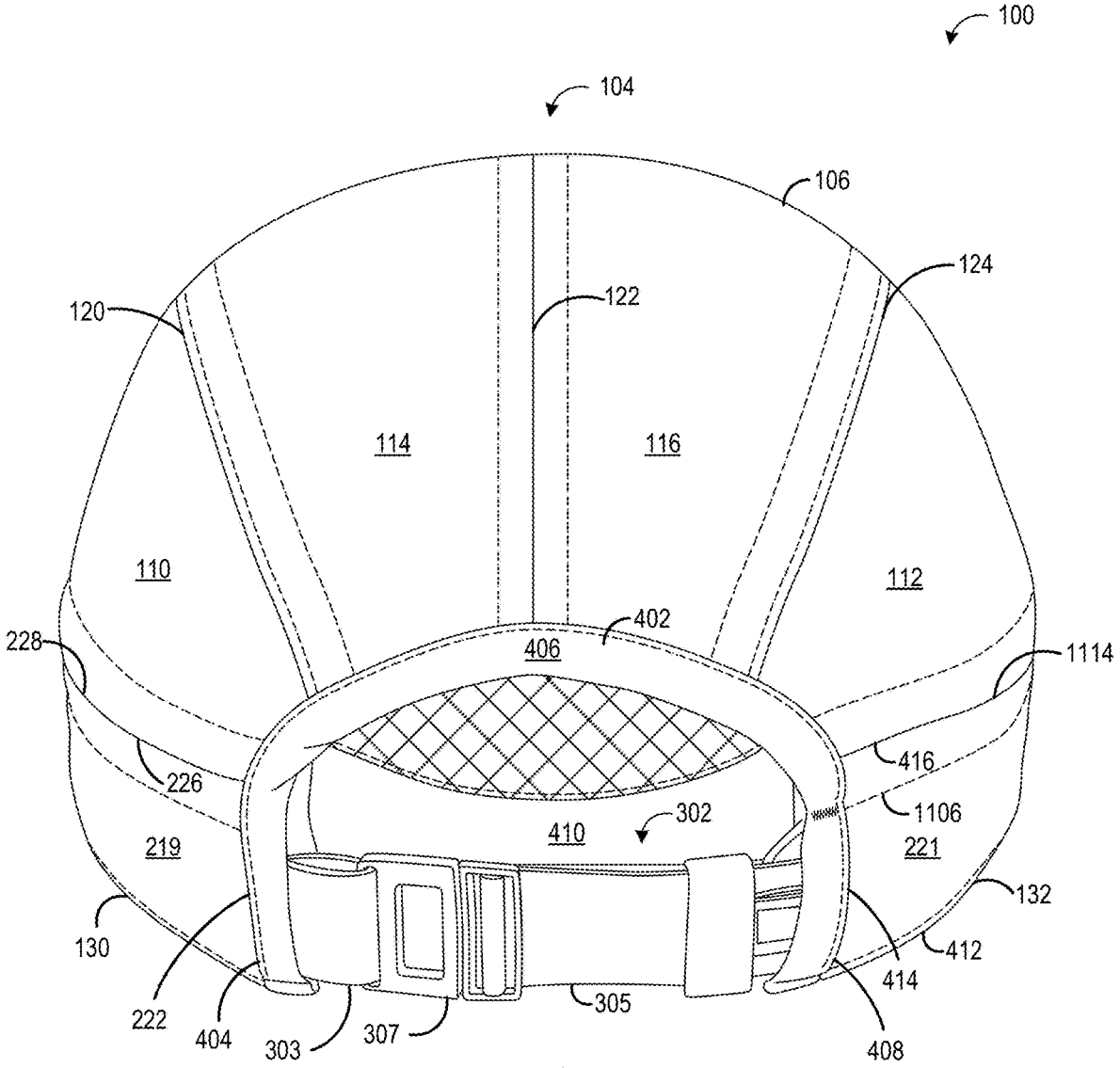
FIG. 4 shows a rear view of the example headwear of FIG. 1.
Figure 5:
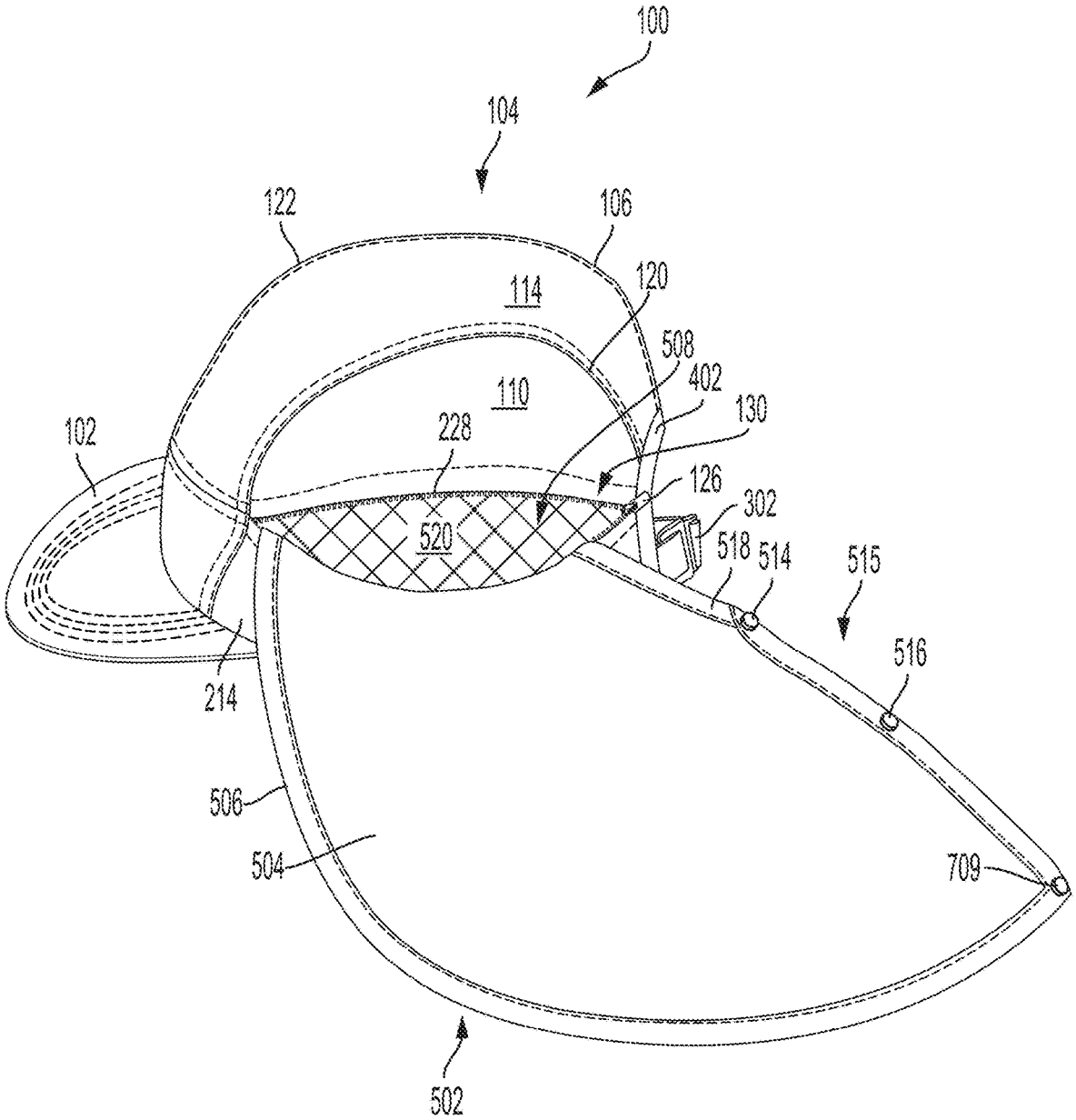
FIG. 5 shows a left side view of the example headwear of FIG. 1 including a first cape of the two-part deployable cape in a deployed position in accordance with one or more embodiments of the present disclosure.
Figure 6:
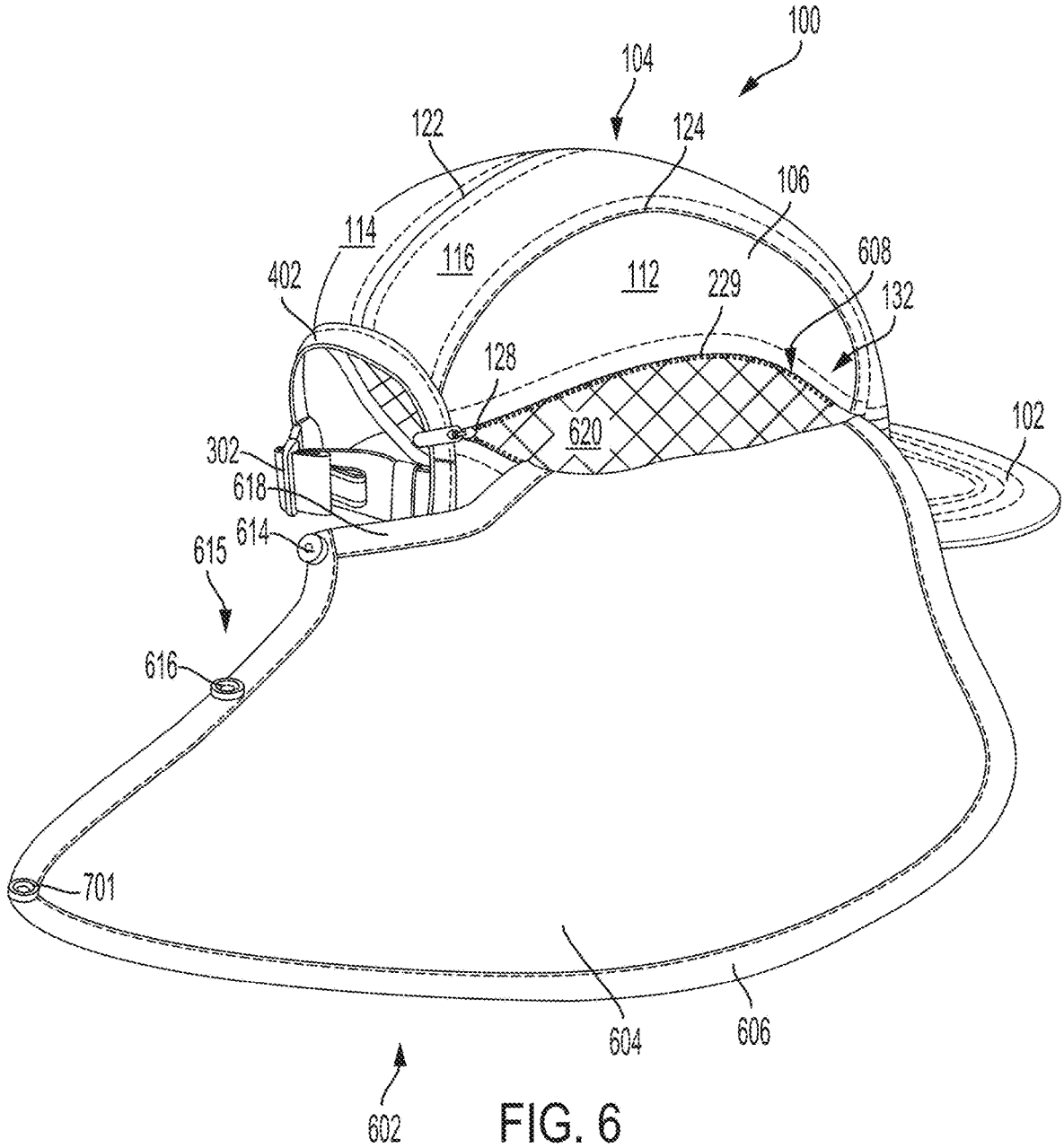
FIG. 6 shows a right side view of the example headwear of FIG. 1 including a second cape of the two-part deployable cape in a deployed position in accordance with one or more embodiments of the present disclosure.
Figure 7:
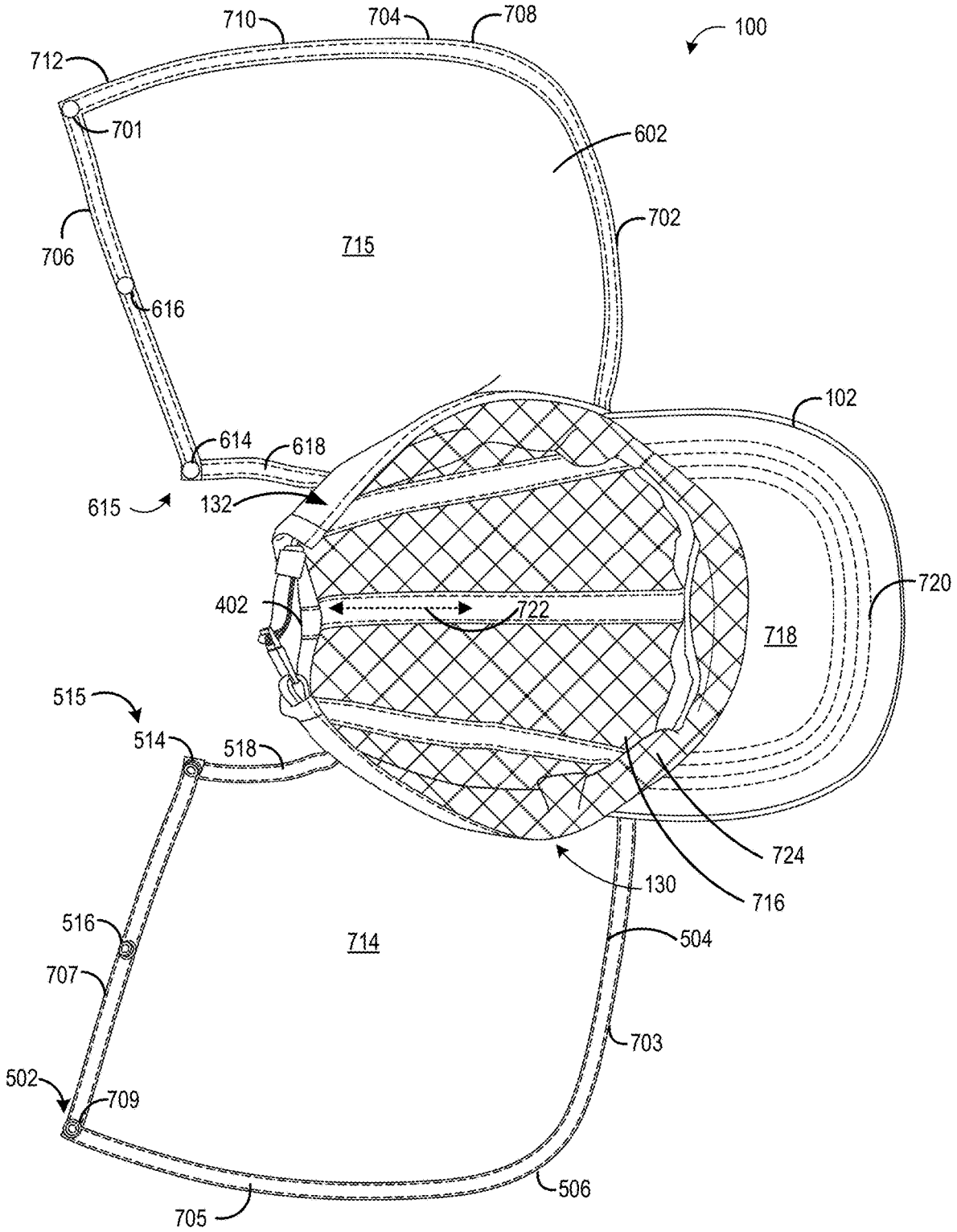
FIG. 7 shows a bottom view of the example headwear of FIG. 1 including each cape of the two-part deployable cape in the deployed position.
Figure 8:
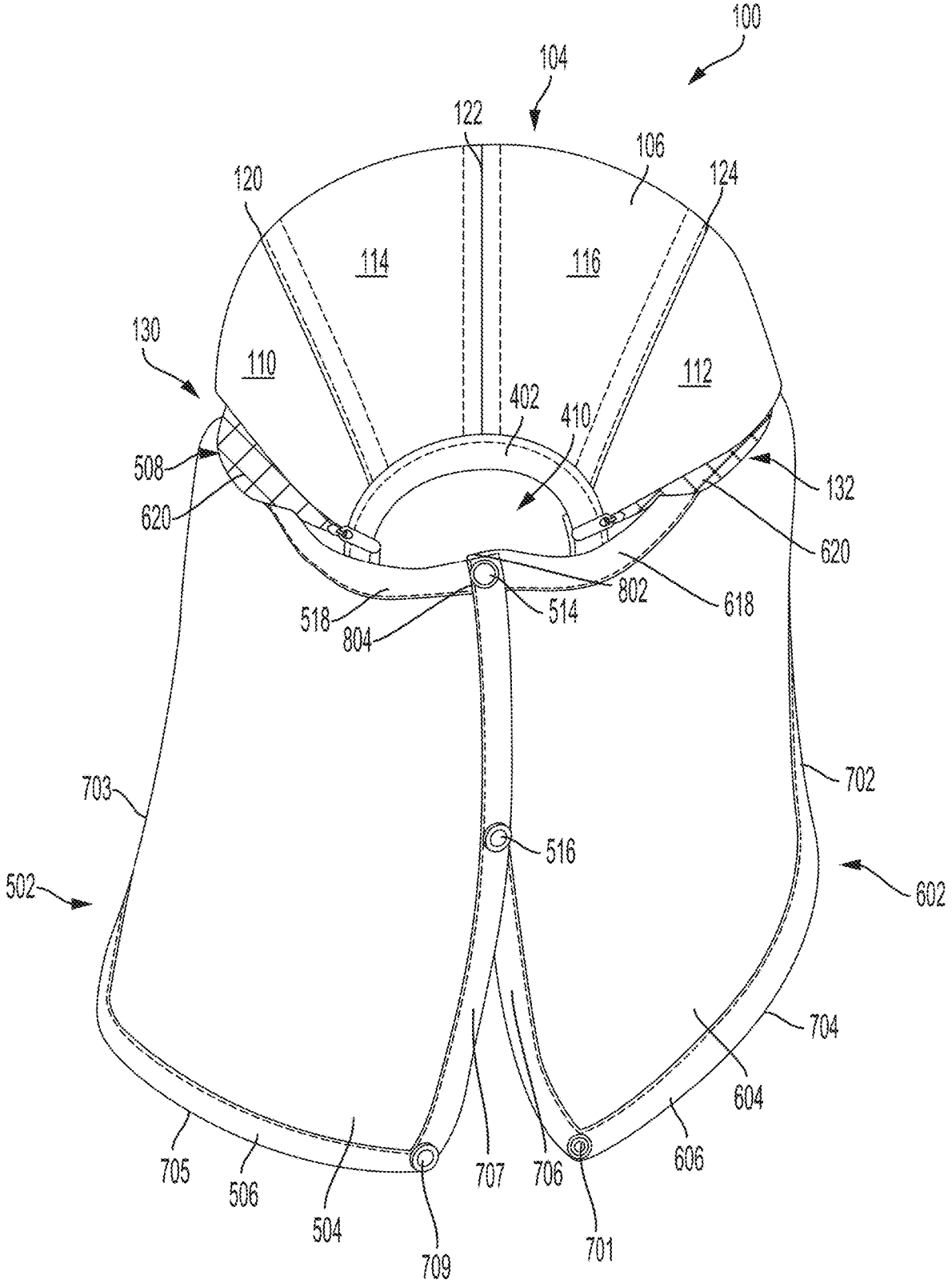
FIG. 8 shows a rear view of the example headwear of FIG. 1 including each cape of the two-part deployable cape in the deployed position.
Figure 9:
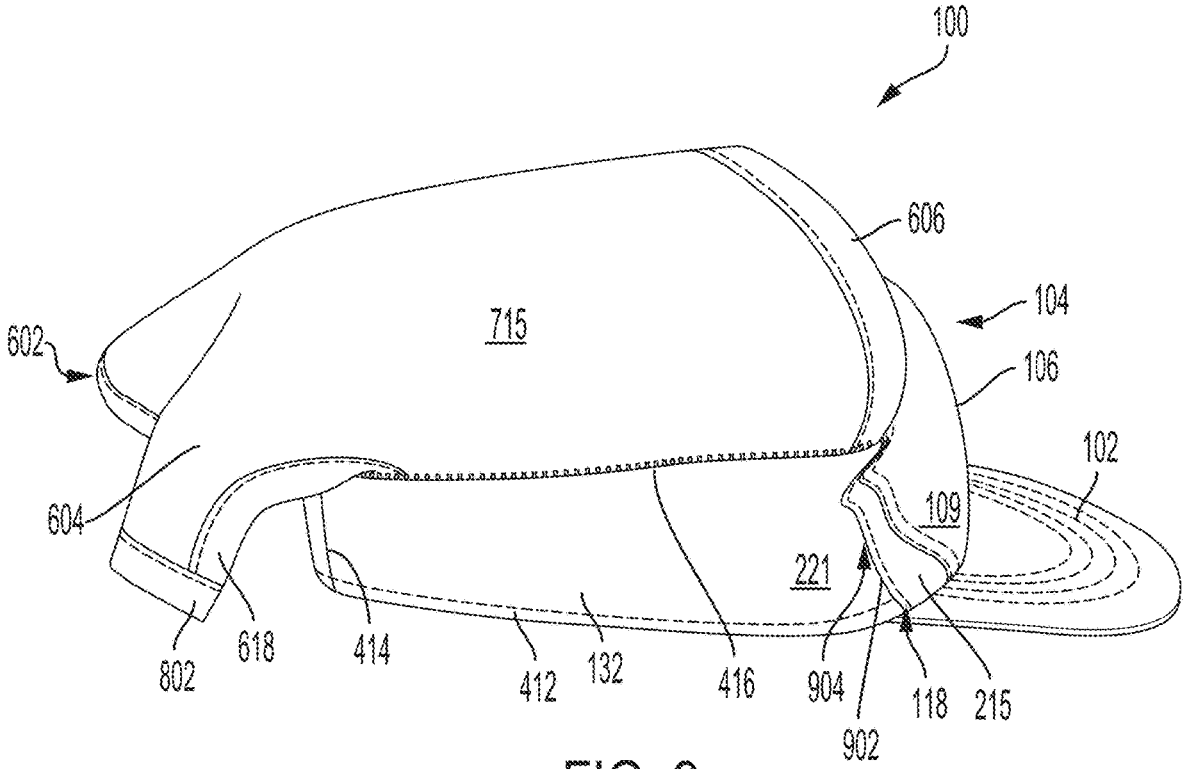
FIG. 9 shows a right side view of the example headwear of FIG. 1 with a deployed cape folded upwards in accordance with one or more embodiments of the present disclosure.
Figure 10:
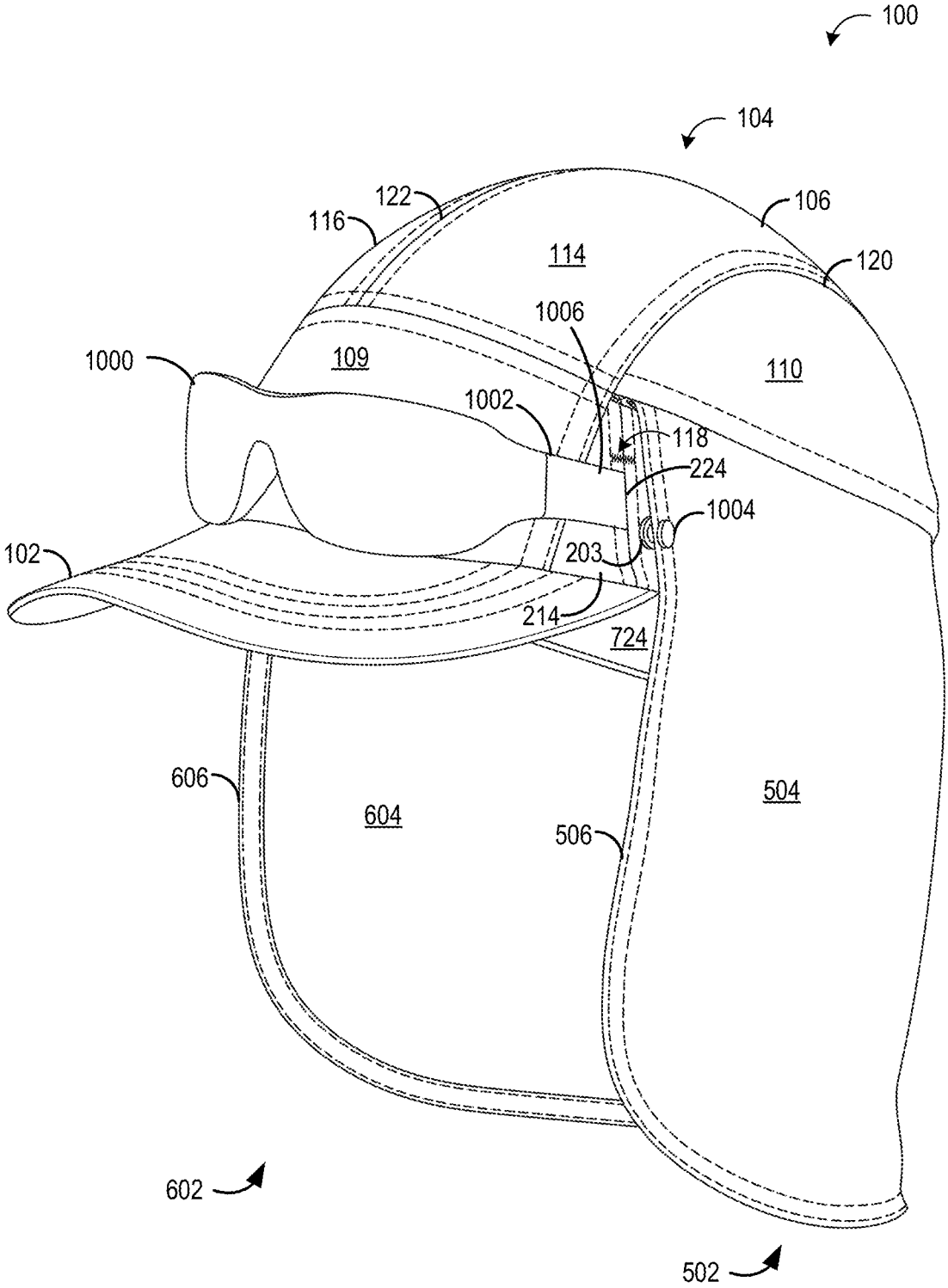
FIG. 10 shows a perspective view of the example headwear of FIG. 1 where the headwear is accommodating optics in accordance with one or more embodiments of the present disclosure.
Figure 11:
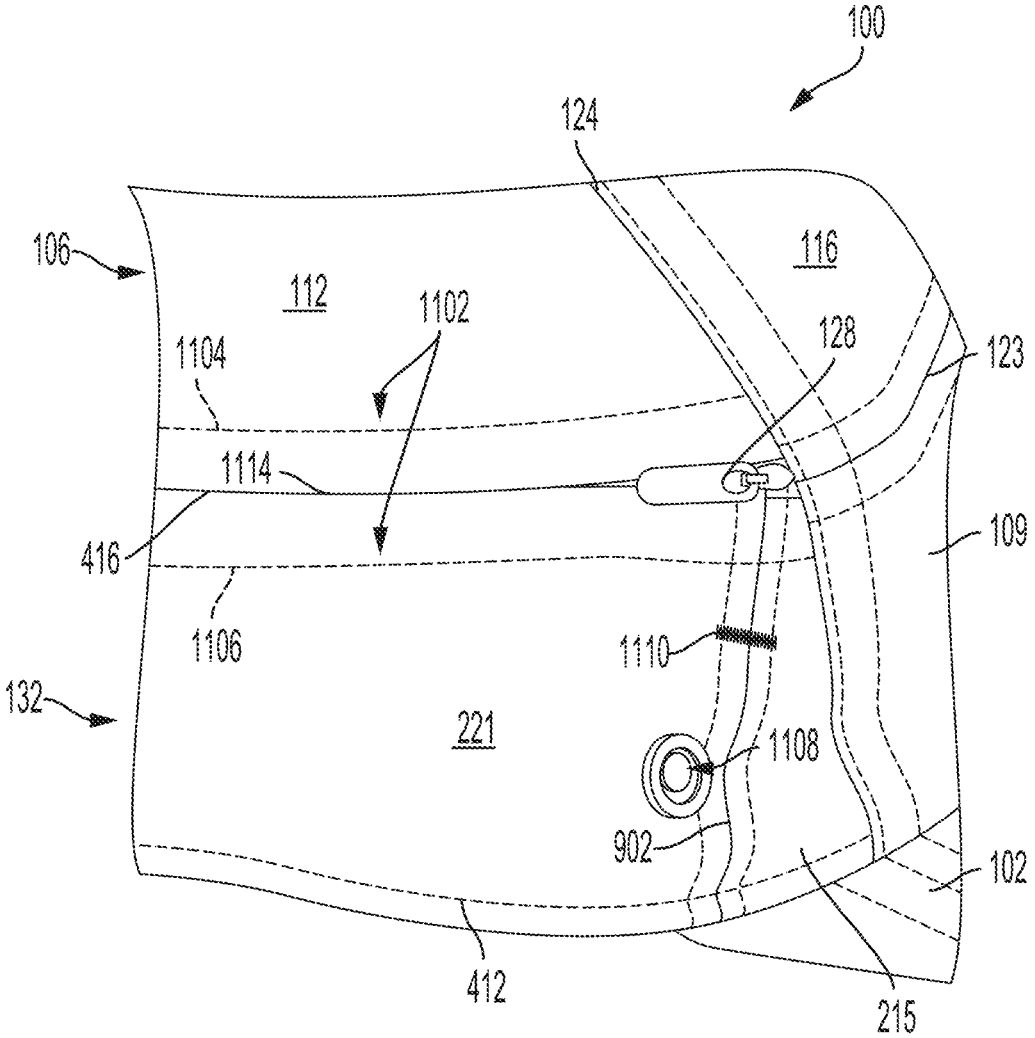
FIG. 11 shows a first magnified view of the example headwear of FIG. 1.
Figure 12:
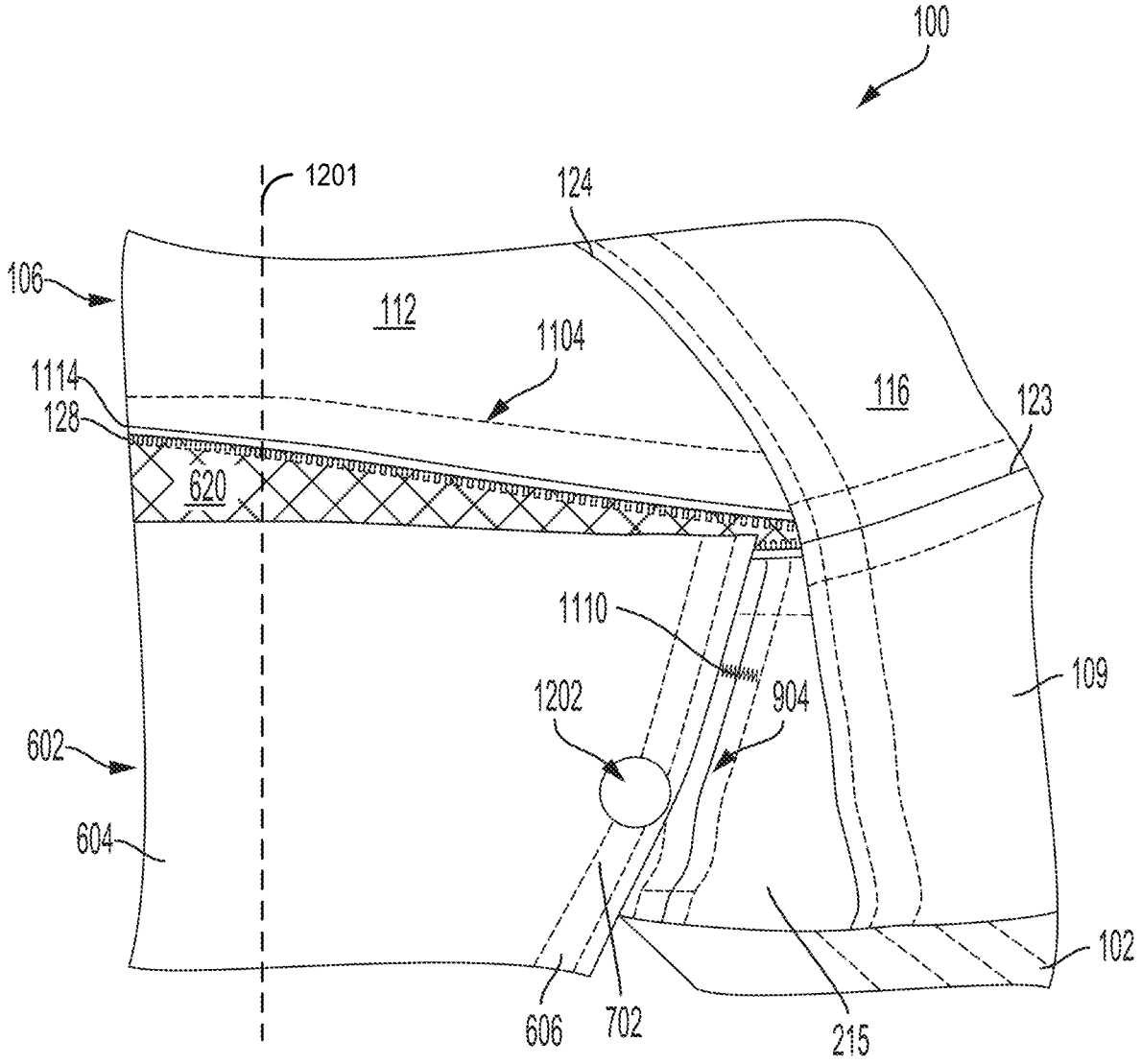
FIG. 12 shows a second magnified view of the example headwear of FIG. 1.

A front view of an example headwear is illustrated in FIG. 1. The headwear may be a cap, and may include a brim and a crown, though other types of headwear are possible without departing from the scope of this disclosure (e.g., the headwear may not include a brim, may not be in the form of a cap, etc.). The crown may include one or more crown panels, and each panel may be coupled together via stitching. Also shown in FIG. 1 are two pockets, where one pocket is positioned on a right side of the headwear and one pocket is positioned on a left side of the headwear. The headwear may include mechanisms for opening and closing the pockets, such as zippers. FIGS. 2-4 show additional views of the headwear of FIG. 1 from the left side, the right side, and the rear. Each pocket of the headwear may include a respective cape, which may be deployed as shown in FIGS. 5 and 6. Each cape may provide additional environmental protection to a wearer of the headwear. FIG. 7 illustrates a bottom view of the headwear with both capes deployed, with coupling snaps visible on each cape. Further, the capes may couple together via the coupling snaps in order to form a larger two-part cape, as illustrated in FIG. 8. Each cape may be deployed from a respective pocket, and may extend outwards between an outer layer of the pocket and the rest of the headwear, as shown in FIG. 9. Further, FIG. 10 illustrates how each pocket may accommodate an arm of a pair of glasses. The arms of the glasses may be positioned within the pockets when the capes are either deployed or retracted. FIGS. 11 and 12 show a first attachment mechanism and a second attachment mechanism, respectively, that may be configured to reduce movement of a deployed cape. FIGS. 1-12 are shown to scale; though other relative dimensions could be used if desired.

FIG. 1 shows a front view of an example headwear 100. FIG. 2, FIG. 3, and FIG. 4 show a left side view, a right side view, and a rear view of the headwear 100, respectively. The headwear 100 may include a brim 102 extending from or otherwise carried by a hat body 104. The hat body 104 may include a crown 106. In some examples, the crown 106 may include multiple panels (e.g., a multi-paneled crown), as shown in FIG. 1. In other examples, the crown 106 may be formed of a single panel or piece of fabric (e.g., a unibody construction) forming any suitable hat body shape. In the illustrated example, the crown 106 may be in the form of a cap configured to extend over a top of a wearer's head. In some examples, the crown 106 may include a plurality of panels extending at least partially around a circumference or perimeter of the crown and intersecting at a central region (e.g., attaching to a top panel of the crown). In some examples, the crown 106 may not include a cap. For example, a cap may be defined as a covering over the top of a wearer's head (e.g., providing material in all areas of the crown). A crown without a cap may include a crown that does not cover all of a wearer's head within the crown. For example, the headwear may be configured as a visor instead of a cap. In such examples, the headwear may include a front crown panel and two side bands, wherein each side band is coupled to the front crown panel on a respective side of the headwear and forms a respective pocket, as explained in more detail below.

In the illustrated example, the crown 106 may include a set of top panels 108, a front panel 109, a first side panel 110, and a second side panel 112. The set of top panels 108 and/or the outer material of the set of top panels 108 may be secured to the surrounding panels via stitching along each side of the set of top panels or by another suitable securing mechanism. In the illustrated example, a plurality of seams attaches the crown panels together. For example, the set of top panels 108 is coupled to the first side panel 110 via a first seam 120. Further, the set of top panels 108 is coupled to the second side panel 112 via a second seam 124. In the illustrated example, the set of top panels 108 may include a first top panel 114 and a second top panel 116 coupled via a third seam 122, and thus the first top panel 114 is coupled to the first side panel 110 via the first seam 120 and the second top panel 116 is coupled to the second side panel 112 via the second seam 124. Additionally, the front panel 109 is coupled to the set of top panels 108 via a fourth seam 123 (e.g., such that a bottom of each of the first top panel 114 and the second top panel 116 is coupled to a top of the front panel 109 via the fourth seam 123).

The front panel 109 may extend from the front of the hat body 104 (e.g., at the brim 102) to the fourth seam 123, and each panel of the set of top panels 108 may extend from the fourth seam 123 to the rear of the hat body. The first side panel 110 may be semi-circular in shape and extend from a point where the front panel 109 couples to the first top panel 114 to the rear of the hat body. The second side panel 112 may be semi-circular in shape and extend from a point where the front panel 109 couples to the second top panel 116 to the rear of the hat body.

In some examples, each panel (or the entirety of the hat body 104 and/or the brim 102) may include the same type of fabric or other material. In other examples, one or more panels (or the brim 102) may include a different type of material than the other panels. The set of top panels 108 and the front panel 109 may each be symmetric along an axis formed approximately in the center of the brim 102.

In the illustrated example, the brim 102 traverses around only a front of the crown 106. The brim 102 may extend across the front panel 109 of the crown 106. The brim 102 may be coupled to the front of the crown 106 along a bottom circumferential edge of the front panel 109. In some examples, the brim 102 may traverse around the entirety of the crown 106. In other examples, the brim 102 may be omitted.

The headwear 100 may include a first pocket 130 and a second pocket 132. For example, the crown 106 may include a first side band positioned vertically below the first side panel 110 that includes multiple layers of material to form the first pocket 130. The crown 106 may include a second side band positioned vertically below the second side panel 112 that includes multiple layers of material to form the second pocket 132. Thus, first pocket 130 may be positioned below the first side panel 110 on a first side of the crown 106. As such, the first pocket 130 may be positioned between a bottom edge 228 of the first side panel 110 and a bottom circumferential edge of the crown 106. Similarly, the second pocket 132 may be positioned below the second side panel 112 on a second side of the crown 106. Further, the second pocket 132 may be positioned between a bottom edge 1114 of the second side panel 112 and a bottom circumferential edge of the crown 106. The first pocket 130 may be partially defined by a first outer layer 219 that forms an outer surface of the first side band of the crown 106. Likewise, the second pocket 132 may be partially defined by a second outer layer 221 that forms an outer surface of the second side band of the crown 106.

In this way, the first pocket 130 and the second pocket 132 may be positioned on opposite sides of the headwear 100. The first pocket 130 may be located on the left side of the headwear 100 and may be visible in FIG. 2. The second pocket 132 may be located on the right side of the headwear 100 and may be visible in FIG. 3. Further, the front panel 109 may be positioned intermediate the first pocket 130 and the second pocket 132 at the front of the headwear 100. Additionally, as illustrated in FIG. 4, a rear edge of the crown 106 (that defines an opening at the rear of the crown 106) and a size adjustment mechanism may be positioned intermediate the first pocket 130 and the second pocket 132 at a rear of the headwear 100. In this way, the first pocket 130 and the second pocket 132 may be separated from each other. Further, the headwear 100 may include a first positioning panel 214 and a second positioning panel 215 positioned in front of the first pocket 130 and the second pocket 132, respectively. For example, the first positioning panel 214 may be positioned between the first pocket 130 (and specifically the first outer layer 219) and the front panel 109 (e.g., on a first side of the front panel 109), and the second positioning panel 215 may be positioned between the second pocket 132 (and specifically the second outer layer 221) and the front panel 109 (e.g., on a second side of the front panel 109).

In some examples, the first outer layer 219 of the first pocket 130 and the second outer layer 221 of the second pocket 132 may be comprised of the same type of fabric or other material as one or more panels of the crown 106 (e.g., the first side panel 110) or the brim 102. In other examples, the first outer layer 219 of the first pocket 130 and the second outer layer 221 of the second pocket 132 may include one or more different types of material than the rest of the crown 106 and/or the brim 102. As described herein, the first pocket 130 and the second pocket 132 may each include an inner layer portion, such as first inner layer portion 520 of the first pocket 130, as shown in FIG. 5, and second inner layer portion 620 of the second pocket 132 as shown in FIG. 6, and the respective outer layer, e.g., the first outer layer 219 of the first pocket 130, as shown in FIG. 2, and the second outer layer 221 of the second pocket 132, as shown in FIG. 3. The inner layer portion of each pocket may be exposed to a head of a wearer of the headwear 100 while the outer layer of each pocket may be exposed to a surrounding environment when the pockets are closed.

In some examples, each inner layer portion of the pockets may include the same type of fabric or other material as each outer layer of the pockets. For example, each inner layer portion (e.g., the first inner layer portion 520) and each outer layer (e.g., the first outer layer 219) may include flexible, woven polyester-based materials. In other examples, each inner layer portion of the pockets may include a different type of fabric or other material than each outer layer of the pockets. In some examples, each inner layer portion of the first pocket 130 and the second pocket 132 may include mesh/visible holes while each outer layer of the first pocket 130 and the second pocket 132 may not include mesh/visible holes. In some examples, the headwear 100 may include a lining (shown in FIG. 7 and described in more detail below) that forms the inner layer portion of each pocket.

The first pocket 130 and the second pocket 132 may each include a fastening mechanism along a top edge (e.g., a top edge 226 of the first pocket 130). In some examples, the first pocket 130 and the second pocket 132 may include a first zipper 126 and a second zipper 128, respectively. The first zipper 126 may open the first pocket 130, allowing at least a portion of the top edge 226 of the first outer layer 219 of the first pocket to separate from the first side panel 110 of the crown. Further, the first zipper 126 may close the first pocket 130, temporarily coupling at least a portion of the top edge 226 of the first outer layer 219 of the first pocket to a bottom edge 228 of the first side panel 110. Similarly, the second zipper 128 may open and close the second pocket 132 by separating and coupling a top edge 416 of the second outer layer 221 of the second pocket 132 to a bottom edge 229 of the second side panel 112 (as shown in FIG. 3). In FIGS. 1-3, only the slider and pull tab of each zipper is visible. FIG. 5 shows a first set of teeth of the first zipper 126. The first set of teeth of the first zipper 126 is coupled to the bottom edge 228 of the first side panel 110. The second zipper 128 also includes a first set of teeth, coupled to the bottom edge 229 of the second side panel 112. Each zipper includes a second set of teeth. The second set of teeth of the first zipper 126 is coupled to the top edge 226 of the first outer layer 219, while the second set of teeth of the second zipper 128 is coupled to the top edge 416 of the second outer layer 221 (e.g., as shown in FIG. 9). In some examples, the first zipper 126 and/or the second zipper 128 may be omitted and each of the first pocket 130 and the second pocket 132 may include hook and loop fasteners, snap fasteners, buckles, combinations thereof, and the like.

Now referring to FIG. 2, the first outer layer 219 of the first pocket 130 may include the bottom edge 220, a back edge 222, a front edge 224, and the top edge 226. The bottom edge 220 and the back edge 222 of the first outer layer 219 may be permanently coupled to the inner layer of the first pocket 130. In some examples, only a portion of the front edge 224 of the first outer layer 219 may be coupled to the inner layer portion of the first pocket 130, or none of the front edge 224 may be coupled to the inner layer portion, resulting in a first slit 202, as described herein. The front edge 224 of the first outer layer 219 may likewise not be coupled to the first positioning panel 214 (at least along the first slit 202). In other examples, an entirety of the front edge 224 may be coupled to the inner layer and the first slit 202 may be omitted or positioned elsewhere. In some examples, the bottom edge 220 may be coupled to the inner layer portion of the first pocket 130 along a bottom circumferential edge of the crown 106. The bottom edge 220, the back edge 222, and optionally the front edge 224 of the first outer layer 219 may be coupled to the inner layer via stitching, gluing, or another suitable permanent coupling method. The top edge 226 of the first outer layer 219 may be selectively coupled to the bottom edge 228 of the first side panel 110 via the first zipper 126, as explained above, or another mechanism (such as snap fasteners, hooks and loops, etc.).

The coupling of the bottom edge 220, the back edge 222, and the top edge 226 of the first outer layer 219 to the first inner layer portion 520 of the first pocket 130 may define an inner volume within the first pocket 130. The inner volume of the first pocket 130 may be accessed by temporarily uncoupling the top edge 226 of the first outer layer 219 from the bottom edge 228 of the first side panel 110 via the fastening mechanism (e.g., via the first zipper 126). In this way, a first deployable cape may be stored in the inner volume of the first pocket 130. The first deployable cape may be hidden from view within the first pocket 130 when the fastening mechanism is in a closed position, and may be deployed from the first pocket 130 when the fastening mechanism is in an open position.

As shown in FIG. 3, the second outer layer 221 of the second pocket 132 may include a bottom edge 412, a back edge 414, the top edge 416 and a front edge 902 that are similar to the edges of the first outer layer 219 of the first pocket 130. As such, the second pocket 132 may include an inner volume and a second deployable cape which are similar to the inner volume and the first deployable cape of the first pocket 130, respectively.

The headwear 100 may include one or more pairs of optics (e.g., sunglasses/glasses) holders 118 along the side of the hat body 104. For example, a slit (e.g., first slit 202) may be present in an outer layer (e.g., the first outer layer 219) of each pocket providing access to one or more optics pockets formed within the outer layer. In the illustrated example, the first slit 202 may be present on the first outer layer 219 of the first pocket 130 (e.g., between the first outer layer 219 and the first positioning panel 214) forming a first opening to provide access to a channel or pocket. In some examples, the first slit 202 may provide access to the first pocket 130 (e.g., between the first outer layer 219 and the inner layer of the first pocket 130). In other examples, the first slit 202 may provide access to a separate/different channel or pocket within the first pocket 130 which may include a first inner surface and a second inner surface (not shown). A second slit 904 may be present on the second outer layer 221 of the second pocket 132 (e.g., between the second outer layer 221 and the second positioning panel 215) forming a second opening to provide access to a second channel or pocket. The second channel or pocket may be the second pocket 132, in some examples, or may be positioned within the second pocket, in other examples. As used herein, it is to be understood that a pocket may be formed of two or more materials coupled together in a manner that enables elements to be inserted therein. For example, earpieces/legs of the frames of the optics may be inserted into the pockets in the outer layers (e.g., the first outer layer 219) of the pockets via the slits.

The headwear 100 further includes a pair of positioning panels positioned toward the front of the hat body on each side of the hat body. The pair of positioning panels may include the first positioning panel 214. The first positioning panel 214 may be an area framed by the front panel 109, the brim 102, and the first outer layer 219. The first positioning panel 214 may be shaped as a triangle, including a bottom edge that is coupled to or extends along the brim 102, a first side edge coupled to or extending along the front panel 109 from the bottom edge of the first positioning panel 214, and a second side edge extending along the first outer layer 219 from the bottom edge of the first positioning panel. The first side edge and the second side edge of the first positioning panel 214 may angle toward each other, terminating at an apex 208 of the first positioning panel that is positioned at an intersection of the first outer layer 219 and the front panel 109. In this way, the first slit 202 may be positioned adjacent to the first positioning panel 214, such that the first positioning panel 214 may be present in front of the first slit 202 (e.g., closer to the front of the headwear 100).

In some examples, the first slit 202 may extend from the apex 208 to a bottom point 210 of the first positioning panel 214 (e.g., where the first positioning panel 214 and the first outer layer 219 terminate at the brim), which may form the bottom circumferential edge of the crown at that region. In some examples, the first slit 202 may be angled such that the apex 208 is positioned closer to a front of the hat body 104 than the bottom point 210. In other examples, the first slit 202 may not be angled or may be angled such that the apex 208 is positioned closer to a rear of the hat body 104 than the bottom point 210. The apex 208 may be positioned at or adjacent the first seam 120 where the first side panel 110 is coupled to the first top panel 114. The bottom point 210 may be positioned at or adjacent a bottom circumferential edge of the crown 106, specifically the bottom edge 220 of the first pocket 130. In the example shown in FIG. 2, the bottom point 210 is positioned at the bottom edge 220 of the first pocket 130 where the first pocket 130 couples to the brim 102. In other examples, the first slit 202 may only extend along a portion of the front edge 224 (e.g., the first slit 202 may terminate at a first tack 216, which is explained in more detail below, and the first positioning panel 214 may be coupled to the first outer layer 219 between the apex 208 and the first tack 216).

The second slit 904 of the second pocket 132 may be the same as the first slit 202 and thus may extend from an apex of the second positioning panel 215 to a bottom point (e.g., where the second positioning panel 215 and the second outer layer 221 terminate) or extend partially along the second positioning panel 215 (e.g., between a top tack and a bottom tack or the bottom point). The second slit 904 may be angled or not angled in the same manner as the first slit 202. The second slit 904 may be positioned adjacent to the second positioning panel 215, which is the same in size and shape as the first positioning panel 214. The second positioning panel 215 may be an area framed by the front panel 109, the brim 102, and the second outer layer 221. The second positioning panel 215 may be positioned adjacent to the second slit 904, such that the second positioning panel 215 may be present in front of the second slit 904.

Each of the first positioning panel 214 and the second positioning panel 215, according to the present disclosure, may serve as an optics guidance feature of the headwear 100. Each of the first positioning panel 214 and the second positioning panel 215 may help in guiding a respective earpiece/leg of the frame of the eyewear into the respective pocket/channel of the optics holders 118, thereby facilitating easy placement of the eyewear in the optics holders 118. Additionally, each of the positioning panels described above may be made of a reflective material. The reflective material of the positioning panels may generate less friction when the earpieces/legs of the eyewear are placed into the first slit 202 and the second slit 904 relative to the material of the set of top panels 108, the front panel 109, and/or the side panels 110, 112, which may help guide the eyewear into the slits. Further, the reflective material may provide high durability, excellent reflective brightness features, and enhanced visibility in some embodiments. In some examples, the positioning panels may be the only areas of the headwear 100 with reflective material, such that the brim 102, the crown 106, etc., are not comprised of reflective material. In other examples, the majority of the crown 106 and the brim 102 may not include reflective material, but one or more additional regions of the brim or crown may include reflective material, e.g., reflective strips or panels may be included on the sides of the crown, at the rear of the crown, etc.

Further, the triangular shape of the first positioning panel 214 and the second positioning panel 215 matches the shape of the headwear 100 at the regions where the positioning panels are located. However, the first positioning panel 214 and the second positioning panel 215 may have a different shape in some examples, such as rectangular, circular, etc.

Each slit of the optics holders 118 may be segmented, in some examples. For example, a dart or tack may be provided across each of the first slit 202 and the second slit 904 in one or more locations to create a more secure holding mechanism for the optics when housed in a given pocket. The darts or tacks may be formed from stitching that intersects the first slit 202 (e.g., horizontal, vertical, or angled stitching) or another suitable mechanism, such as glue, RF welding, etc. In the illustrated example, one tack is positioned across each of the first slit 202 and the second slit 904. As shown, the first tack 216 may be positioned across the first slit 202. The first tack 216 may be positioned perpendicular with respect to the first slit 202, though other arrangements are possible without departing from the scope of this disclosure, so long as the first tack 216 segments the first slit 202 into multiple openings or frames the opening of the first slit 202. In some examples, a second tack may be positioned at the bottom point 210, whereas the first tack 216 may be positioned closer to the apex 208 than to the bottom point 210, in the illustrated example. Since the first positioning panel 214 abuts the first slit 202 (or extends into the opening/pocket created by the first slit 202), a portion of the first tack 216 and, when included, the second tack, may also overlap the first positioning panel 214. The first tack 216 and the second tack (when included) may each have a suitable length, such as ¼ of an inch.

The segmentation of slits (e.g., the first slit 202) creates a more secure optics holding mechanism and provides flexibility of where eyewear may be positioned relative to the headwear 100. In one example, eyewear including curved earpieces may be inserted into the slits (e.g., the first slit 202) of the optics holders 118 above the darts or tacks (e.g., above the first tack 216), and the respective dart or tack may provide a security mechanism to catch the curved region of the earpieces if the eyewear inadvertently slides out of the pockets/channels of the optics holders 118. In this position, the eyewear may be held in position higher up on the crown 106 of the headwear 100 (e.g., above the brim 102). In other examples, eyewear may be inserted into the slits (e.g., the first slit 202) below the tacks (e.g., below the first tack 216), and the tacks may provide a security mechanism to prevent the earpieces from traveling or angling upward toward the top of the headwear 100. In this position, the eyewear may be held in position lower down relative to the headwear 100, such as on top of the brim 102 or below the crown 106 and/or the brim 102, where the eyewear may be worn by the wearer (e.g., across the wearer's eyes).

When the optics holders 118 includes two tacks per side, the bottom tacks may be provided to maintain structural integrity of the headwear 100, prevent puckering of the side panels at the slits, and/or create a target opening size, and may be omitted in some examples. As such, each of the optics holders 118 form one or two openings. However, additional tacks may be included such that more than two openings are formed (e.g., three openings may be formed by including another tack at each slit, with the additional tack positioned below the first tack), or the first tack 216 may act to terminate the first slit 202 such that each of the optics holders 118 forms only one opening. Further, the headwear 100 does not include a headband and thus the slits (e.g., the first slit 202) extend to the bottom circumferential edge of the headwear where the headwear terminates and/or couples to the brim 102. This positioning of the slits may allow for eyewear to be secured in the optics holders 118 even when the eyewear is being worn across eyes of a wearer of the headwear. Further, in some examples, one or more structural tacks (e.g., similar to the bottom tacks) may be positioned elsewhere relative to the slits.

As described above, each positioning panel may be triangular shaped, which may result in each positioning panel being wider across a bottom portion of the positioning panel than across a top portion of the positioning panel. This shape may provide feedback to the wearer of the headwear when inserting earpieces/legs of the eyewear into the optics holders 118, in order to allow the wearer a sense of whether the eyewear is being inserted above or below the tacks. Further, it is to be understood that the optics holders 118 and positioning panels described herein may be utilized in any other suitable headwear than those illustrated. For example, a full-brim hat (and/or a hat with a larger brim than that illustrated), a hat without a brim, a cap-less visor, or an ear band (e.g., a panel extending around the forehead/ears without a brim or a top crown) may include the optics holders and positioning panels described herein.

In some examples, material may be inserted into the slits and/or around the opening/edges of the slits to further prevent and/or promote movement of the optics out of/into the pockets. For example, material having a relatively more adhesive quality (e.g., rubber, texturized material for gripping, silicone, rough fabric, etc.) may be utilized within a pocket and/or along an interior of the edges of openings of the slits to help retain inserted optics within the pocket. Material having a relatively less adhesive or slicker quality (e.g., metal, leather, smooth plastic/fabric, etc.) may be provided along edges of the slits and/or an outer region of the slits in order to promote insertion of optics into the slits/pocket and/or guide the optics into the slits/pocket.

As shown in FIGS. 2-4, the headwear 100 includes a size adjustment mechanism 302 positioned at the rear of the crown 106 (e.g., opposite the brim 102). The size adjustment mechanism 302 may be configured to adjust a size/circumference of the crown 106 to match a wearer's head and may be any suitable size adjustment mechanism, such as a snapback mechanism, a pullable strap, a ballistic mechanism, etc. The size adjustment mechanism 302 may be coupled to a back edge 402 of the crown 106. The size adjustment mechanism 302 and the back edge 402 are described in more detail with respect to FIG. 4.

As illustrated, the first pocket 130 may be positioned in an area that is framed by the first positioning panel 214, the first side panel 110, the back edge 402, and a bottom circumferential edge of the crown 106. The first pocket 130 may be coupled (e.g., directly coupled) to the first positioning panel 214, the back edge 402, and the bottom circumferential edge of the crown 106 via stitching, gluing, or another suitable coupling method (though the bottom edge of the first pocket 130, e.g., the bottom edge of the first outer layer 219, may form the bottom circumferential edge of the crown in the region of the first pocket 130). The top edge 226 of the first pocket 130 may be selectively coupled to the bottom edge 228 of the first side panel 110. The top edge 226 and the bottom edge 228 may be coupled via the first zipper 126, which when in an open position may allow the top edge and the bottom edge to separate from each other. In this way, the first pocket 130 may be opened, and a deployable cape may be accessed.

In some examples, the headwear 100 may include various stitch lines (e.g., a first stitch line 1104, a second stitch line 1106) and attachment mechanisms (e.g., a first attachment mechanism 1108, a fourth attachment mechanism 203) that are described in more detail below with respect to FIG. 11. However, in some examples, the stitch lines and attachment mechanisms shown in FIG. 11 may be omitted. Additionally, as shown in FIG. 3, the second slit 904 may be defined or framed by a second tack 1110.

FIG. 4 shows a rear view of the headwear 100, including the back edge 402 and the size adjustment mechanism 302. In the example shown, the size adjustment mechanism 302 includes a first strap portion 303 and a second strap portion 305 removably couplable to each other via a suitable fastener 307, with one of the strap portions being adjustable in length. The back edge 402 may be collectively formed from or otherwise be coupled to a respective back edge of each of the first pocket 130, the first side panel 110, the first top panel 114, the second top panel 116, the second side panel 112, and the second pocket 132. The back edge 402 may include a first end portion 404, a middle portion 406, and a second end portion 408. The middle portion 406 may have a curvature that is greater than zero (e.g., not a straight line) and may couple to the crown 106, e.g., to the first side panel 110, the second side panel 112, and the set of top panels 108 (e.g., the first top panel 114 and the second top panel 116). The first end portion 404 and the second end portion 408 may have little to no curvature (e.g., straight lines) and may couple to a back edge of the first pocket 130 (e.g., the back edge 222) and the second pocket 132, respectively. Further, the first end portion 404 may house a portion of the size adjustment mechanism 302 (e.g., a terminating edge of the first strap portion 303) and the second end portion 408 may house a different portion of the size adjustment mechanism 302 (e.g., a terminating edge of the second strap portion 305). The back edge 402 may be coupled to the panels of the crown 106, the first pocket 130, and the second pocket 132 via stitching, gluing, or another suitable coupling method.

The size adjustment mechanism 302 may adjust a position of the first end portion 404 and the second end portion 408, relative to each other. For example, the size adjustment mechanism 302 may be adjusted in order to move the first end portion 404 and the second end portion 408 closer together or farther apart. In this way, a circumference of a bottom circumferential edge of the crown 106 may be adjusted by the size adjustment mechanism 302 to fit a head of a wearer of the headwear 100.

The back edge 402 may create an opening 410 in the crown 106 at the back of the headwear 100. The size adjustment mechanism 302 may be positioned across a bottom portion of the opening 410. One end of the size adjustment mechanism 302 (e.g., the first strap portion 303) may couple to the first end portion 404 of the back edge 402, and an opposite side of the size adjustment mechanism (e.g., the second strap portion 305) may couple to the second end portion 408 of the back edge. In this way, the opening 410 may be an area framed by the back edge 402 and the size adjustment mechanism 302. The opening 410 may provide space for a pony-tail, or another hairstyle that may protrude from the head of a wearer, and as such, the headwear 100 may be more desirable to wear with a variety of hairstyles. Further, the opening 410 may provide ventilation to the head of the wearer of the headwear 100. In some examples, the headwear 100 may not include the opening 410, and one or more panels of the crown 106 may extend downward to the size adjustment mechanism 302.

The back edge 402 and the opening 410 may be positioned between the first pocket 130 and the second pocket 132 at the rear of the headwear 100. As such, the first pocket 130 and the second pocket 132 may be separated by the opening 410, and may be positioned at opposite sides (e.g., a left side and a right side) of the headwear 100. In this way, deployable capes may be housed in and deployed from opposite sides of the headwear 100.

FIG. 5 shows a left side view of the headwear 100 including a first cape 502 deployed from the first pocket 130. The first pocket 130 may have an inner volume 508 that is enclosed by the first outer layer 219 and the first inner layer portion 520 of the first pocket. When the first zipper 126 is in a closed position, the inner volume 508 may be sealed such that the inner volume is not exposed to the surrounding environment. The first zipper 126 may be moved to an open or partially open position to reveal the inner volume 508 to the environment.

The inner volume 508 of the first pocket 130 may house the first cape 502. The first cape 502 may be stowed in the inner volume 508 and the first pocket 130 may be closed in order to conceal the first cape 502 within the headwear 100. This may be beneficial when a wearer of the headwear 100 desires for the headwear to take the appearance of a cap without one or more capes. In some examples, the first cape 502 may be folded, scrunched, or manipulated in another suitable way so that the first cape 502 may fit within the inner volume 508 of the first pocket 130. FIGS. 1-4 depict the headwear 100 with the first cape 502 in a stowed position (e.g., stowed within the first pocket 130), along with the second cape in a stowed position (e.g., stowed within the second pocket 132).

The first cape 502 may be deployed from the first pocket 130 when the first zipper 126 is in an open position. When deployed, a portion of the first cape 502 may remain within the inner volume 508 of the first pocket 130. The portion of the first cape 502 that remains within the inner volume 508 may include one or more edges or sections of the first cape 502 that are coupled to a portion of the interior of the first pocket 130 via stitching, gluing, or another suitable coupling method. In this way, the first cape 502 may remain coupled to the headwear 100 in the deployed position. A second portion of the first cape 502 may be positioned outside of the first pocket 130 when in the deployed position, as illustrated in FIG. 5. The second portion of the first cape (e.g., the portion outside of the first pocket 130) may provide a wearer of the headwear 100 with additional protection from environmental factors, such as sun, wind, and precipitation. When the headwear 100 is positioned on a head of a wearer, the first cape 502 may hang downwards (e.g., in the direction of gravity), as illustrated in FIG. 8, and may cover at least a portion of a neck, a back, or shoulders of the wearer.

As shown in FIG. 5, the first cape 502 may include a cape body 504 and a terminating edge 506. The cape body 504 may be comprised of one or more layers of material that extend continuously, as shown, and/or the cape body 504 may be comprised of one or more layers of material that are each formed from separate panels stitched or otherwise coupled together. The cape body 504 may include a top surface, shown in FIG. 5, and a bottom surface, shown in FIG. 7. The terminating edge 506 may be positioned at and/or form the outer edges of the cape body 504 and as such, may surround at least a portion of the cape body 504. In some examples, the terminating edge 506 may be comprised of one or more separate pieces of material coupled to the cape body 504 via stitching, gluing, or another suitable coupling method. In other examples, the terminating edge 506 may be a hem of the cape body 504. In some examples, the terminating edge 506 may be coupled to the entire circumferential edge of the cape body 504. In other examples, the terminating edge 506 may not be coupled to at least a portion of the circumferential edge of the cape body 504, such as the portion of the cape body that is coupled to the inner volume 508 of the first pocket 130. The terminating edge 506 may increase the durability of the first cape 502 by reducing fraying, tearing, or other similar degradation at the edges of the first cape.

The headwear further comprises one or more fasteners configured to couple the first cape to the second cape when the first cape and the second cape are deployed. For example, the first cape 502 may include a first set of fasteners 515 positioned on a rear portion of the terminating edge 506. The first set of fasteners 515 may be configured to couple to fasteners on a second deployable cape, and as such may hold the first cape 502 and the second cape together at the rear of the headwear 100. In this way, the first set of fasteners 515 may allow the first cape 502 and the second cape (shown in FIG. 6 and described in more detail below) to shield at least a portion of a neck of a wearer of the headwear 100 from environmental conditions (e.g., sun, wind, etc.). In the illustrated example, the first set of fasteners 515 of the first cape 502 may include a first snap fastener 514, a second snap fastener 516, and a third snap fastener 709. In some examples, the first cape 502 may include more than three snap fasteners, such as four snap fasteners. In other examples, the first cape 502 may include a single snap fastener or two snap fasteners. In some examples, the first cape 502 may not include snap fasteners and may instead include one or more other suitable fastening mechanisms such as buttons or hooks and eyes.

The terminating edge 506 may include a top edge. A first portion (not shown) of the top edge may be coupled (e.g., stitched) to a surface within the first pocket 130. For example, the first portion of the top edge of the first cape 502 may be coupled to an inner side of the first outer layer 219 within the inner volume 508 of the first pocket 130, below the first zipper 126. A second portion 518 of the top edge may be a terminating edge that is not coupled to a surface within the first pocket 130. As such, the second portion 518 may be free to be moved from within the first pocket 130 to outside of the first pocket 130, and vice versa. Further, the second portion 518 of the top edge may be positioned towards the rear of the first cape 502. The second portion 518 may allow the first cape 502 to be easily oriented downwards (e.g., in the direction of gravity) and towards the rear of the headwear 100, without excessive folding, bunching, or the like of the first cape. The second portion 518 may be comprised of elastic material that, when stretched, extends relatively horizontally without curvature and, when relaxed, curves downward toward the bottom of the first cape. The rest of the first cape 502 may be comprised of a non-elastic material or a material with less elasticity than the second portion 518.

When the first cape 502 is deployed, as shown in FIG. 5, the cape body 504 may extend outward from the inner volume 508 of the first pocket 130 and bend/fold to then extend downward along the first outer layer 219. The first cape 502 may thereby cover all or a majority of the top edge 226 of the first outer layer 219 when deployed.

FIG. 6 shows a right side view of the headwear 100 including a second cape 602 deployed from the second pocket 132. The second cape 602 is similar to the first cape 502, and may include a cape body 604, a terminating edge 606, and a second set of fasteners 615 including a fourth snap fastener 614, a fifth snap fastener 616, and a sixth snap fastener 701. The fourth snap fastener 614, the fifth snap fastener 616, and the sixth snap fastener 701 may be complementary to the first snap fastener 514, the second snap fastener 516, and the third snap fastener 709, respectively, such as the fourth snap fastener 614, the fifth snap fastener 616, and the sixth snap fastener 701 being male ends while the first snap fastener 514, the second snap fastener 516, and the third snap fastener 709 are female ends (or vice versa). In some examples, the second set of fasteners 615 may have more or less than three fasteners but may include an identical number of fasteners to the number of fasteners included in the first set of fasteners 515. The cape body 604 may be comprised of one or more layers of material that extend continuously, as shown, and/or the cape body 604 may be comprised of one or more layers of material that are each formed from separate panels stitched or otherwise coupled together. The cape body 604 may include a top surface, shown in FIG. 6, and a bottom surface, shown in FIG. 7. The second cape 602 may be housed in and deployed from an inner volume 608 of the second pocket 132. Further, the fourth snap fastener 614, the fifth snap fastener 616, and the sixth snap fastener 701 may couple to the first snap fastener 514, the second snap fastener 516, and the third snap fastener 709 of the first cape 502, respectively. In this way, the first set of fasteners 515 and the second set of fasteners 615 may couple the first cape 502 and the second cape 602 together at the rear of the headwear 100.

The terminating edge 606 of the second cape 602 may include a top edge that includes a first portion that is coupled to the second pocket 132 (e.g., to an inner side of the second outer layer 221) and a second portion 618 that may be positioned inside or outside of the second pocket 132 depending on the orientation of the second cape 602. The second portion 618 and the second portion 518 may be configured to allow the second cape 602 and the first cape 502 to join together at the rear of the headwear 100 to form the overall/two-part cape that has a shape that mimics a single-panel cape. As such, the second portion 618 and the second portion 518 may be coupled via snap fasteners (e.g., the first snap fastener 514 and the fourth snap fastener 614) such that the second portions extend all the way across a rear portion of the crown 106 (e.g., across the opening 410). Further, the second portion 618 and the second portion 518 allow the second cape 602 and the first cape 502 to be stowed in the second pocket 132 and the first pocket 130, respectively, when the capes are not deployed. The second portion 618 may be comprised of elastic material similar to the second portion 518.

FIG. 7 shows a bottom view of the headwear 100 including the first cape 502 and the second cape 602. In some examples, the first cape 502 and the second cape 602 may be mirror images of each other, and therefore may be identical in size and shape when reflected over an axis 722. Further, the first cape 502 and the second cape 602 may be oriented such that each cape extends from the headwear 100 outwards and towards the rear of the headwear 100 (e.g., away from the brim 102). The terminating edge 606 of the second cape 602 may include a first edge portion 702, a second edge portion 704, and a third edge portion 706. The first edge portion 702 may be positioned at the front of the second pocket 132 (e.g., proximate the brim 102). Further, the third edge portion 706 may be positioned at the rear of the second pocket 132 (e.g., proximate the size adjustment mechanism 302). In some examples, the first edge portion 702 may curve towards the back (e.g., away from the brim 102) of the headwear 100. Further, in some examples, the third edge portion 706 may be relatively straight (e.g., no or minimal curvature). The third edge portion 706 may extend a suitable length, such as in a range of 6-8 inches. The second portion 618, when stretched, may extend with a length of 3-4 inches. However, other dimensions are possible without departing from the scope of this disclosure.

The second edge portion 704 may be positioned at an end of the second cape 602 that is distal the crown 106 (e.g., the bottom of the cape), and may be intermediate the first edge portion 702 and the third edge portion 706. In some examples, the second edge portion 704 may include a front portion 708, a middle portion 710, and a rear portion 712. The front portion 708 of the second edge portion 704 may be coupled to the first edge portion 702. Further, the front portion 708 may have a radius of curvature in a range of 2-3 inches. The rear portion 712 of the second edge portion 704 may be coupled to the third edge portion 706. Further, the rear portion 712 may have a radius of curvature in a range of 0.75-1.5 inches. As such, the rear portion 712 may be more curved than the front portion 708. The middle portion 710 of the second edge portion 704 may be positioned intermediate the front portion 708 and the rear portion 712, and may be relatively straight (e.g., no or minimal curvature). In this way, the curvature of the first edge portion 702, the second edge portion 704, and the third edge portion 706 may cause the first the second cape 602 to be oriented towards the rear of the headwear 100. Similarly, the terminating edge 506 of the first cape 502 may include a first edge portion 703, a second edge portion 705, and a third edge portion 707 that are similar to the first edge portion 702, the second edge portion 704, and the third edge portion 706, respectively.

The third edge portion 706 may include the second set of fasteners 615 which may include the fourth snap fastener 614, the fifth snap fastener 616, and the sixth snap fastener 701. The fourth snap fastener 614 and the fifth snap fastener 616 may be positioned according to the description of FIG. 6 (e.g., with the fourth snap fastener 614 positioned where the third edge portion 706 meets the second portion 618 and the fifth snap fastener 616 positioned intermediate the fourth snap fastener 614 and the sixth snap fastener 701). The sixth snap fastener 701 may be positioned at the junction between the rear portion 712 and the third edge portion 706. Similarly, the third edge portion 707 may include the first set of fasteners 515 which may include the first snap fastener 514, the second snap fastener 516, and the third snap fastener 709. The first snap fastener 514 and the second snap fastener 516 may be positioned according to their descriptions with respect to FIG. 5 (e.g., with the first snap fastener 514 positioned where the third edge portion 707 meets the second portion 518 and the second snap fastener 516 positioned intermediate the first snap fastener 514 and the third snap fastener 709). The third snap fastener 709 may be positioned at the junction between the second edge portion 705 and the third edge portion 707.

In some examples, a bottom surface 714 of the first cape 502 and a bottom surface 715 of the second cape 602 may include the same pattern or design as a top surface of the first cape 502 and the second cape 602. In other examples, the bottom surface 714 and the bottom surface 715 may include a different pattern or design than a top surface of the first cape 502 and the second cape 602. A bottom surface 718 of the brim 102 may include the same pattern or design or a different pattern or design than a top surface of the brim. Further, in some examples, the bottom surface 718 of the brim 102 may include stitching 720. The stitching 720 may provide additional structural support to the headwear 100.

The crown 106 may include a lining 716. An inner surface of the lining 716 may face a wearer of the headwear 100 and may come into face sharing contact with the head of the wearer. Further, portions of an outer surface of the lining 716 may form the inner layer portions of the first pocket 130 and the second pocket 132 (e.g., the second inner layer portion 620). The lining 716 may include holes for ventilation and to reduce the buildup of heat and/or perspiration of a head of a wearer. Additionally, the lining 716 may include seam liners to hide and/or protect seams of the lining. For example, the lining 716 may be comprised of four panels joined by respective seams. In some examples, the lining 716 does not extend along the entirety of the crown. For example, the lining may not line the front panel 109 of the crown. In some examples, the lining 716 may be coupled to the crown only along the bottom circumferential edge and/or along the seam between the front panel and the top panel of the crown. In some examples, the lining 716 may only be coupled to the crown at one or more tack spots to create a larger pocket. The crown 106 may further include a sweatband 724. The sweatband 724 may be positioned along a bottom circumferential surface of the headwear 100 in the interior of the crown. The sweatband 724 may extend from a first side of the back edge 402 to a second side of the back edge 402. Further, the sweatband 724 may be positioned such that the lining 716 is intermediate the sweatband 724 and panels of the crown (e.g., the front panel 109). The sweatband 724 may be coupled to the bottom circumferential edge of the crown.

FIG. 8 shows a rear view of the headwear 100 with the first cape 502 and the second cape 602 deployed. The first cape 502 and the second cape 602 may be hanging downwards (e.g., in the direction of gravity) and may be positioned at the rear of the headwear 100 (e.g., opposite the brim 102). The first zipper 126 may be in an open position and the first cape 502 may be deployed from the first pocket 130. Further, the inner volume 508 and the first inner layer portion 520 of the first pocket 130 may be exposed to the outside environment. Similarly, the second zipper 128 may be in an open position and the second cape 602 may be deployed from the second pocket 132. Further, the inner volume 608 and the second inner layer portion 620 of the second pocket 132 may be exposed to the outside environment.

In some examples, one cape may be deployed while the other cape remains housed in a pocket. For example, the first pocket 130 may be open and the first cape 502 may be deployed while the second pocket 132 remains closed and the second cape 602 remains housed within the second pocket. Similarly, the second pocket 132 may be open and the second cape 602 may be deployed while the first pocket 130 remains closed and the first cape 502 remains housed within the first pocket. As such, a wearer of the headwear 100 may choose to have neither cape, only the first cape 502 or the second cape 602, or both the first cape 502 and the second cape 602 deployed from their respective pockets at a given point in time.

The second portion 518 of the top edge of the first cape 502 may be free to move relative to the rest of the headwear 100. As such, the second portion 518 may be positioned within the first pocket 130 when the first cape 502 is stowed in the first pocket 130, and at least a part of the second portion 518 may be positioned outside of the first pocket 130 when the first cape 502 is deployed. A first portion (not shown) of the top edge of the first cape 502 may be positioned within the first pocket 130 and may be coupled (e.g., stitched) to a surface within the first pocket 130. The second portion 618 of the top edge of the second cape 602 may be free to move relative to the rest of the headwear 100. As such, the second portion 618 may be positioned within the second pocket 132 when the second cape 602 is stowed in the second pocket 132, and at least a part of the second portion 618 may be positioned outside of the second pocket 132 when the second cape 602 is deployed. The first portion (not shown) of the top edge of the second cape 602 may be positioned within the second pocket 132 and may be coupled (e.g., stitched) to a surface within the second pocket 132.

The second portion 518 and the second portion 618 of the first cape 502 and the second cape 602, respectively, may each extend radially around the rear portion of the crown 106 when the first cape 502 and the second cape 602 are deployed and coupled together. The shapes of the second portion 518 and the second portion 618 may allow the first cape 502 and the second cape 602 to be stored and deployed from a left side and a right side, respectively, of the headwear 100 while still providing coverage at the rear of the headwear when deployed. Further, the second portion 518 and the second portion 618 may allow the capes to extend from the rear of the headwear 100 to the sides of the headwear, also providing coverage to at least a portion of the left side and at least a portion of a right side of the headwear. As such, the first cape 502 may provide coverage on the first side and a portion of the rear side of the headwear 100 and the second cape 602 may provide coverage on the second side and a portion of the rear of the headwear 100.

The first edge portion 702 and the first edge portion 703 of the second cape 602 and the first cape 502, respectively, may each extend downwards and curve towards the rear of the headwear 100. The first edge portion 702 may extend downwards at a right side of the headwear 100 and the first edge portion 703 may extend downwards at a left side of the headwear. In this way, the first cape 502 and the second cape 602 may cover the sides of a head of a wearer. A portion of the second edge portion 704 of the second cape 602 and a portion of the second edge portion 705 of the first cape 502 may each be oriented parallel to the ground when the capes are deployed. Further, the third edge portion 706 of the second cape 602 may extend vertically downwards from an end 802 of the second portion 618. Similarly, the third edge portion 707 of the first cape 502 may extend vertically downwards from an end 804 of the second portion 518. At least a portion of the third edge portion 706 may be oriented parallel to at least a portion of the third edge portion 707.

The first cape 502 may be coupled to the second cape 602 via coupling between the first snap fastener 514 and the fourth snap fastener 614 and coupling between the second snap fastener 516 and the fifth snap fastener 616. The first snap fastener 514 and the second snap fastener 516 may be positioned on the third edge portion 707 of the terminating edge 506. Similarly, the fourth snap fastener 614 and the fifth snap fastener 616 may be positioned on the third edge portion 706 of the terminating edge 606. As such, at least a portion of the third edge portion 707 of the first cape 502 may overlap at least a portion of the third edge portion 706 of the second cape 602, when the first cape 502 is coupled to the second cape 602 via the snap fasteners. In this way, the first cape 502 and the second cape 602 may come together to mimic a single-panel cape and may provide additional environmental protection at the rear of the headwear.

When deployed and coupled together, the first cape 502 and the second cape 602 may cover the size adjustment mechanism 302. However, the first cape 502 and the second cape 602 may not fully cover the opening 410 (e.g., a top of the opening may remain unobstructed even when the first cape 502 and the second cape 602 are deployed and coupled together as shown in FIG. 8). As such, the opening 410 may still accommodate a pony-tail or other hairstyle when the first cape 502 and the second cape 602 are deployed and coupled at the rear of the headwear 100.

FIG. 9 shows a right side view of the headwear 100 with the second cape 602 deployed and positioned to reveal the second pocket 132 (e.g., the second cape 602 is folded over the top of the crown 106 to reveal the second pocket 132). A portion of the second cape 602 may be positioned between the second outer layer 221 of the second pocket 132 and the second inner layer portion 620 of the second pocket 132. Further, in the view shown in FIG. 9, another portion of the second cape 602 may be positioned on top of the crown 106 of the headwear 100, such that a top surface of the second cape 602 may be resting in face sharing contact with a top surface of the crown. The end 802 of the second portion 618 may be positioned outside of the second pocket 132 when the second cape 602 is deployed while a second end of the second portion 618 (not visible in FIG. 9) may be positioned within the second pocket 132. When the second cape 602 is stowed in the second pocket 132, the second portion 618 including the end 802 may be positioned within the second pocket 132.

In some examples, as shown in FIG. 12, the front edges of the first cape 502 and the second cape 602 may include a respective fastener configured to couple to a complementary fastener positioned on the first pocket 130 and the second pocket 132, respectively. For example, the bottom surface 715 of the second cape 602 may include a snap fastener. The snap fastener may be positioned proximate the second pocket 132 when the second cape 602 is deployed. Further, the second outer layer 221 of the second pocket 132 may include a snap fastener that is configured to mate with the snap fastener on the bottom surface 715. In this way, the snap fasteners may removably couple the second cape 602 to the second outer layer 221 of the second pocket 132. As such, at least a portion of the second cape 602 may be held in place by the snap fasteners and movement of the second cape 602 may be reduced. By reducing movement of the second cape 602, the second cape may provide continuous protection from environmental conditions. Further, the snap fasteners may prevent the second cape 602 from flying around in certain conditions (e.g., traveling in an open air vehicle), which may be desirable by a wearer of the headwear 100. The first cape 502 and first pocket 130 may include similar snap fasteners. In other examples, such as the illustrated example, the snap fasteners on the bottom surfaces of the first and second capes and corresponding fasteners on the first and second outer layers may be omitted from the headwear 100.

FIG. 10 shows a perspective view of the headwear 100 with the first cape 502 and the second cape 602 deployed. Glasses 1000 (e.g., optics) may include arms, such as arm 1002, and may be positioned on the headwear 100 such that the arms are positioned within the optics holders 118 of the headwear. For example, a portion of the arm 1002 may have been passed through the first slit 202 of the headwear 100. The first slit 202 of the optics holders 118 may stabilize the arm 1002, securing the glasses 1000 on the headwear 100 while allowing a wearer to easily remove the glasses from the headwear when desired.

The first slit 202 may lead to the inner volume 508 of the first pocket 130. As such, a portion of the arm 1002 may be positioned within the inner volume 508 of the first pocket 130, as illustrated in FIG. 10. Similarly, a second arm of the glasses 1000 may be positioned within the inner volume 608 of the second pocket 132. The portion that is positioned within the second pocket 132 may be exposed to the environment when the second pocket is open (e.g., when the second cape 602 is deployed). Further, the second cape 602 and the portion may both be housed within the inner volume 608 of the second pocket when the second zipper 128 is in a closed position. A portion 1006 of the arm 1002 may be positioned outside of the optics holders 118, and as such may not be positioned within the inner volume 608 of the second pocket 132.

In some examples, a portion of the arms of the glasses 1000 may not be positioned within the first pocket 130 and the second pocket 132 when the glasses 1000 are positioned in the optics holders 118. Instead, portions of the arms may be positioned within a pocket/channel that is formed in the outer layers of the pockets (e.g., within the second outer layer 221). As such, the outer layers of the pockets may be formed of an inner surface and an outer surface that are coupled together along a bottom edge, a back edge, and a top edge. A front edge of the inner surface and the outer surface may not be slits (e.g., the first slit 202) and may not be coupled together. In this way, the arms of the glasses 1000 may not be housed in the same place as the first cape 502 and the second cape 602.

In the example that the first cape 502 or the second cape 602 are extended from the first pocket 130 and the second pocket 132, respectively, a portion of the arms of the glasses 1000 may be positioned underneath the first cape 502 or the second cape 602. The arms of the glasses 1000 may be positioned within the first pocket 130 and second pocket 132 or within pockets/channels formed in the outer layers of the pockets, and the first cape 502 and second cape 602 may extend over the outer layers of the pockets (e.g., over the first outer layer 219 and over the second outer layer 221). In some examples, the first cape 502 may include a third attachment mechanism 1004 affixed to the terminating edge 506 of the first cape 502 such that the third attachment mechanism 1004 aligns with the fourth attachment mechanism 203 when the first cape 502 is extended. The fourth attachment mechanism 203 and the third attachment mechanism 1004 may have mating surfaces in face sharing contact that may allow the first cape 502 to be fastened to the first outer layer 219 of the first pocket 130. The second cape 602 likewise includes a second attachment mechanism 1202 configured to mate with the first attachment mechanism 1108, similar to the third attachment mechanism 1004.

In some examples, as shown in FIG. 11, the headwear 100 of FIGS. 1-10 may include additional hems to provide structural stability and facilitate coupling of adjacent structures. As shown in FIG. 11, the headwear 100 may include two stitch lines 1102 such as the first stitch line 1104 and the second stitch line 1106. The first stitch line 1104 may be positioned on the second side panel 112. Further, the first stitch line 1104 may be positioned proximate to and above a bottom edge 1114 of the second side panel 112. The first stitch line 1104 may be parallel to the bottom edge 1114 and may extend from a front edge of the second side panel 112 (e.g., where the second side panel 112 terminates at the second top panel 116) to a back edge of the second side panel 112 (e.g., where the second side panel 112 terminates at the back edge 402). As such, the first stitch line 1104 may extend from the second seam 124 towards a rear of the headwear 100. The first stitch line 1104 may couple the lining 716 (shown in FIG. 7) to the crown 106, may shape the headwear 100, and/or may reduce degradation of the headwear at or proximate to the second zipper 128. A third stitch line 232 similar to the first stitch line 1104 may be included on the first side panel 110, in some examples. The third stitch line 232 may be visible in FIG. 2.

The second stitch line 1106 may be positioned on the second outer layer 221 of the second pocket 132. Further, the second stitch line 1106 may be positioned proximate to and below the top edge 416 of the second outer layer 221. The second stitch line 1106 may be parallel to the top edge 416 and may extend from the back edge 414 of the second outer layer 221 to the front edge 902 of the second outer layer 221. Further, the second stitch line 1106 may extend past the front edge 902 and across a portion of the second positioning panel 215. The second stitch line 1106 may extend across the front edge 902 at a position intermediate the top edge 416 and the second tack 1110. The second tack 1110 may be similar to the first tack 216 of FIG. 2. The second stitch line 1106 may couple the outer surface of the second outer layer 221 to the inner surface of the outer layer such that the second stitch line 1106 creates a hem along the second outer layer 221 and couples the second cape 602 to the second outer layer 221 (on an inner side of the second outer layer 221, within the second pocket 132). In some examples, the second cape 602 may be coupled to the second pocket 132 at the second stitch line 1106. However, the second cape may be coupled to the second pocket at other locations within the second pocket without departing from the scope of this disclosure. A stitch line similar to the second stitch line 1106 may be included on the first outer layer 219 of the first pocket 130, in some examples, such as a fourth stitch line 230 visible in FIG. 2. In some examples, the first cape 502 may be coupled to the first pocket 130 at the fourth stitch line 230. However, the first cape may be coupled to the first pocket at other locations within the first pocket without departing from the scope of this disclosure.

As illustrated in FIG. 11, the headwear 100 of FIGS. 1-10 may include, in some examples, a first attachment mechanism 1108. The first attachment mechanism 1108 may be a snap fastener, a button, a clip, or the like. The first attachment mechanism 1108 may be positioned on the second outer layer 221 of the second pocket 132. Further, the first attachment mechanism 1108 may be positioned proximate the front edge 902 and intermediate the second tack 1110 and the bottom circumferential edge of the crown. The first attachment mechanism 1108 may be configured to couple to the second cape 602 when the second cape 602 is deployed from the second pocket 132 and, as such, may reduce movement of the second cape (e.g., movement induced by wind). The fourth attachment mechanism 203 identical to the first attachment mechanism 1108. The fourth attachment mechanism 203 may be positioned on the first outer layer 219 of the first pocket 130. Further, the fourth attachment mechanism 203 may be positioned proximate the front edge 224 and intermediate the first tack 216 and the bottom circumferential edge of the crown. The fourth attachment mechanism 203 may be configured to couple to the first cape 502 when the first cape 502 is deployed from the first pocket 130 and, as such, may reduce movement of the first cape 502 (e.g., movement induced by wind).

In some examples, as shown in FIG. 12, the headwear 100 of FIGS. 1-10 may include the second attachment mechanism 1202 positioned on the second cape 602. The second attachment mechanism 1202 may be a snap fastener acceptor, a button hole, or the like, such that the second attachment mechanism is complementary to and configured to couple to the first attachment mechanism 1108 of FIG. 11 (it should be appreciated that the components could be swapped such that the second cape 602 includes the snap fastener and the second outer layer 221 includes the snap fastener acceptor, etc.). At least a portion of the second attachment mechanism 1202 may be positioned on the first edge portion 702 of the terminating edge 606. In this way, the second attachment mechanism 1202 may be positioned proximate a front edge of the second cape 602. In some examples, a portion of the second attachment mechanism 1202 may be positioned on the cape body 604 of the second cape 602. The second attachment mechanism 1202 may be configured to couple to the first attachment mechanism 1108 in a way that reduces movement of the second cape 602 relative to the crown 106 of the headwear 100. As such, the first attachment mechanism 1108 and the second attachment mechanism 1202 may be configured to keep the second cape 602 positioned proximate to a wearer (e.g., may reduce moment of the second cape 602 away from the wearer). In this way, the first attachment mechanism 1108 and the second attachment mechanism 1202 may allow the headwear 100 to more often shield the wearer from environmental factors (e.g., wind, sun, rain, etc.) when the second cape 602 is deployed from the second pocket 132.

Further, as appreciated by FIGS. 10 and 12, when the capes are in the deployed position (e.g., fully removed from the respective pocket and positioned to drape down over the wearer's ears and neck), the front edge of each cape (e.g., the first edge portion 702 of the second cape 602 and the first edge portion 703 of the first cape 502) may be angled, away from the front of the headwear 100 and toward the rear of the headwear 100 at an angle that at least approximately matches the angle of the front edge of the respective pocket. For example, as shown in FIG. 12, the second cape 602 is deployed and hanging downward over the second pocket 132. The first edge portion 702 of the second cape 602 is angled relative to a vertical axis 1201 that is parallel to gravity, such as angled at an angle of 20 degrees relative to the vertical axis 1201. The front edge 902 likewise angles away from the vertical axis 1201 and toward the rear of the headwear 100 at an angle of, for example, 20 degrees. The angling of the front edge of the capes and pockets may provide several advantages. For example, the capes may be easier to stow and remove from the respective pockets due to the angling of the front edges of the capes, as the capes may have less material at the front relative to capes that have a front edge that is not angled relative to the vertical axis 1201. Further, the angling may ensure that the slits of the optics holders 118 are available to easily accommodate optics even when the capes are deployed and held in place via the attachment mechanisms that are configured to secure the capes to the pockets, as shown in FIG. 10. Additionally, the angling allows to the capes to hang proximate the terminating edges of the brim but without contacting the brim.

Thus, the headwear 100 comprises the crown 106, which includes the first pocket 130 positioned on the first side of the crown 106 and the second pocket 132 positioned on the second side of the crown 106, the first side being opposite the second side. The first cape 502 is housed in and deployable from the first pocket 130. The first cape 502 is configured to extend from the first side to the rear of the crown 106 when deployed and comprises the first set of fasteners 515. The second cape 602 is housed in and deployable from the second pocket 132. The second cape 602 is configured to extend from the second side to the rear of the crown 106 when deployed and comprises the second set of fasteners 615, the second set of fasteners 615 configured to couple to the first set of fasteners 515. Additionally, the headwear 100 includes the size adjustment mechanism 302 positioned at the rear of the crown 106, wherein the size adjustment mechanism 302 and the back edge 402 of the headwear 100 frame the opening 410 (e.g., an open area) at the rear of the crown. The first pocket 130 terminates at the opening 410 and the second pocket 132 terminates at the opening 410, and the first cape 502 and the second cape 602 extend across a bottom of the opening 410 when coupled together via the first set of fasteners 515 and the second set of fasteners 615. At least a top of the opening 410 remains open/unobstructed by elements of the headwear 100 when the first cape 502 and the second cape 602 are deployed (e.g., and coupled together via the first and second sets of fasteners). The size adjustment mechanism 302 includes the first strap portion 303, the second strap portion 305, and the fastener 307 configured to selectively couple the first strap portion 303 to the second strap portion 305. The first strap portion 303 extends from the back edge 402 of the crown at the first pocket 130 and the second strap portion 305 extends from the back edge 402 of the crown at the second pocket 132.

The first pocket 130 is comprised of the first outer layer 219 and the first inner layer portion 520, and the second pocket 132 is comprised of the second inner layer portion 620 and the second outer layer 221. The top edge 226 of the first outer layer 219 of the first pocket 130 is coupled to a first panel of the crown (e.g., the first side panel 110) via the first zipper 126, and the top edge 416 of the second outer layer 221 of the second pocket 132 is coupled to a second panel of the crown (e.g., the second side panel 112) via the second zipper 128. The first zipper 126 selectively couples the first outer layer 219 to the first side panel 110, such that when the first zipper 126 is closed, the first outer layer 219 is coupled to the first side panel 110 and when the first zipper 126 is open, the first outer layer 219 is not coupled to the first side panel 110. Likewise, the second zipper 128 selectively couples the second outer layer 221 to the second side panel 112, such that when the second zipper 128 is closed, the second outer layer 221 is coupled to the second side panel 112 and when the second zipper 128 is open, the second outer layer 221 is not coupled to the second side panel 112.

The crown 106 includes the first top panel 114, the second top panel 116, the front panel 109, the first side panel 110, and the second side panel 112. The first top panel 114 and the second top panel 116 are positioned intermediate the first side panel 110 and the second side panel 112, and the front panel 109 is positioned in front of the first top panel 114 and the second top panel 116. The first pocket 130 is positioned adjacent (e.g., below) the first side panel 110 and the second pocket 132 is positioned adjacent (e.g., below) the second side panel 112. The various crown panels may be directly coupled to each other as described above via seams, e.g., the first seam 120 may directly couple the first side panel 110 to the first top panel 114; the second seam 124 may directly couple the second side panel 112 to the second top panel 116; the third seam 122 may directly couple the first top panel 114 to the second top panel 116; the fourth seam 123 may directly couple the front panel 109 to the first top panel 114 and the second top panel 116.

The first cape 502 includes the cape body 504 and the terminating edge 506 and the second cape 602 includes the cape body 604 and the terminating edge 606, the terminating edge 506 at least partially surrounding the cape body 504, the terminating edge 606 at least partially surrounding the cape body 604. The first set of fasteners 515 are positioned on the terminating edge 506 and the second set of fasteners 615 are positioned on the terminating edge 606. The terminating edge 506 of the first cape 502 includes a first top edge and the terminating edge 606 of the second cape 602 includes a second top edge. A first portion of the first top edge and a second portion of the second top edge are coupled to the crown 106 (e.g., permanently coupled), and a third portion of the first top edge (the second portion 518) and a fourth portion of the second top edge (the second portion 618) are not coupled to the crown, and are each comprised of an elastic material. Rather, the second portion 518 and the second portion 618 are each free to move relative to the crown 106. The second portion 518 and the second portion 618 are each configured to extend radially around the rear of the crown 106 when the first cape 502 and the second cape 602 are deployed and held in place via the first set of fasteners 515 and the second set of fasteners 615. Additionally, the first cape 502 may include a first attachment mechanism and the second cape 602 may include a second attachment mechanism, the first fastener configured to couple to a third attachment mechanism positioned on the first side of the crown 106, and the second attachment mechanism configured to couple to a fourth attachment mechanism positioned on the second side of the crown 106. For example, the second attachment mechanism may be the first attachment mechanism 1108 and the fourth attachment mechanism may be the second attachment mechanism 1202.

Further, the crown 106 includes the first positioning panel 214 positioned on the first side of the headwear 100 and the second positioning panel 215 positioned on the second side of the headwear, the first positioning panel 214 positioned adjacent the first slit 202 and the second positioning panel 215 positioned adjacent the second slit 904, wherein the first slit 202 provides access to the first pocket 130 (e.g., to the inner volume 508) and the second slit provides access to the second pocket 132 (e.g., to the inner volume 608). The first positioning panel 214 is triangular shaped and terminates at the apex 208. The first positioning panel has a first back edge 223 and the first outer layer 219 has the front edge 224, the first back edge 223 and the front edge 224 defining the first slit 202 (e.g., at the first slit 202, the first back edge 223 and the front edge 224 are not directly coupled, but the first back edge 223 is directly coupled to the front edge 224 above the first slit 202, such as above the first tack 216). The first back edge 223 may have a first height from the bottom circumferential edge of the crown/headwear to the apex 208 that is equal to a second height of the front edge 224. The second positioning panel 215 is similar, e.g., the second positioning panel 215 is triangular shaped and terminates at an apex, has a second back edge that, along with the front edge of the second outer layer 221 defines the second slit 904, and the second back edge has the first height and the front edge of the second outer layer 221 has the second height. Additionally, the first positioning panel 214 is positioned below the first zipper 126, and the second positioning panel 215 is positioned below the second zipper 128.

The headwear 100 further includes the brim 102 extending partially around the bottom circumferential edge of the headwear. For example, the brim 102 extends below the front panel 109, the first positioning panel 214, and the second positioning panel 215. Further, the brim 102 may terminate at the first pocket 130 and at the second pocket 132, such that the brim 102 does not extend under the first pocket 130 or the second pocket 132, at least in some examples.

It is to be appreciated that the headwear 100 described herein includes a crown with a five-panel construction (e.g., two side panels, two top panels, and one front panel). However, other configurations are possible without departing from the scope of this disclosure. For example, the front panel could be omitted and the first top panel and the second top panel could extend all the way from the brim to the back edge of the crown. In another example, the crown could be comprised of six panels that intersect an apex of the crown (e.g., triangular shaped panels). In such an example, the six panels may include two front panels that extend from the apex to the brim, a first side panel that extends from the apex to the top of the first pocket, a second side panel that extends from the apex to the top of the first pocket and a part of the rear edge, a third side panel that extends from the apex to the top of the second pocket, and a fourth side panel that extends from the apex to the top of the second pocket and another part of the rear edge. In either example, the first and second pockets, as well as the first and second positioning panels, may remain as described above. In still further examples, the first pocket and the second pocket may be accessed via openings provided on an interior of the headwear rather than an exterior of the headwear. For example, outer layer(s) of the crown may be selectively coupled to inner layer portions of the crown via fasteners (e.g., zippers) that are positioned on the interior of the crown and when the fasteners are opened, the first cape and the second cape may be deployed and hang downward along the interior of the crown (e.g., along the first pocket and the second pocket in the interior of the crown), rather than hanging over the exterior of the first pocket and the second pocket. Further, the positioning panels and/or optics holders could be omitted. When the positioning panels are omitted, the leading edges of the first pocket and the second pocket may couple to or otherwise terminate at a front portion of the crown, such as the front panel 109.

The example headwear described above provides many technical advantages. For example, a two-part deployable cape comprised of two separate capes that may be removably joined together may shield a neck of a wearer from environmental conditions such as sun, wind, or rain. One cape may be deployed at a time, with the capes being deployed from opposite sides of the headwear. Further, the headwear maintains a functional poly-tail hole and functional optics holders while the capes are in both a deployed and a retracted position.

The individual capes may deploy from pockets that are situated on either side of the headwear. Further, the capes may snap together at the rear of the headwear to form a full cape. The headwear may include a pony-tail hole that is functional when the capes are in both the deployed and retracted positions. Additionally, the headwear may include snaps at the temple, positioned behind entrances to optics holders, which may snap to the cape to hold it in place. The headwear may be fully lined in a mesh wicking material.

As used herein, the term "tack" may refer to intersecting stitching as described above, but may also include virtually any anchor mechanism that can delineate a top opening from a bottom opening, including but not limited to an RF weld, glue, and stitching other than horizontal stitching (e.g., vertical stitching, a circular dot of stitching, etc.). Further, in some examples, the tacks described herein may reversibly anchor one or more top layers of material to one or more underlying layers of material, and thus may include snaps, buttons, hook and loop fasteners, etc. Additionally, as used herein, the term "headwear" may include any article configured to be worn on a head of a wearer, including caps, visors, ear bands, etc. Headwear as defined herein may include headwear with a brim, without a brim, with a crown (that covers a top of a wearer's head), or without a crown.

The disclosure also provides support for headwear, comprising: a first pocket positioned on a first side of the headwear and a second pocket positioned on a second side of the headwear, the first side being opposite the second side, and a set of capes comprising a first cape housed in and deployable from the first pocket and a second cape housed in and deployable from the second pocket. In a first example, the first cape is configured to extend from the first side to a rear of the headwear and the second cape is configured to extend from the second side to the rear of the headwear. In a second example, optionally including the first example, the headwear further comprises: one or more fasteners configured to couple the first cape to the second cape. In a third example, optionally including one or both of the first and second examples, the headwear further comprises: a size adjustment mechanism positioned at the rear of the headwear, wherein the size adjustment mechanism and a back edge of each of the first pocket and the second pocket frame an open area at the rear of the headwear, the first pocket terminating at the open area and the second pocket terminating at the open area, and wherein the first cape and the second cape extend across the open area when coupled together via the one or more fasteners. In a fourth example, optionally including one or more or each of the first through third examples, at least a top of the open area remains open when the first cape and the second cape are deployed. In a fifth example, optionally including one or more or each of the first through fourth examples, the first pocket is comprised of a first outer layer and a first inner layer portion, and the second pocket is comprised of a second inner layer portion and a second outer layer. In a sixth example, optionally including one or more or each of the first through fifth examples, an inner volume of the first pocket is accessible via a first zipper, and wherein an inner volume of the second pocket is accessible via a second zipper. In a seventh example, optionally including one or more or each of the first through sixth examples, the first cape includes a first cape body and a first terminating edge and the second cape includes a second cape body and a second terminating edge, the first terminating edge at least partially surrounding the first cape body, the second terminating edge at least partially surrounding the second cape body. In an eighth example, optionally including one or more or each of the first through seventh examples, the first terminating edge of the first cape includes a first top edge and the second terminating edge of the second cape includes a second top edge, wherein a first portion of the first top edge and a second portion of the second top edge are coupled to the first pocket and the second pocket, respectively, and a third portion of the first top edge and a fourth portion of the second top edge are not directly coupled to the first pocket or the second pocket, the third portion of the first top edge and the fourth portion of the second top edge being free to move relative to the headwear. In a ninth example, optionally including one or more or each of the first through eighth examples, the one or more fasteners include a first set of fasteners positioned on the first terminating edge and a second set of fasteners positioned on the second terminating edge. In a tenth example, optionally including one or more or each of the first through ninth examples, the third portion of the first top edge and the fourth portion of second top edge are each configured to extend radially around the rear of the headwear when the first cape and the second cape are deployed and held in place via the first set of fasteners and the second set of fasteners. In an eleventh example, optionally including one or more or each of the first through tenth examples, the first cape includes a first attachment mechanism and the second cape includes a second attachment mechanism, the first attachment mechanism configured to couple to a third attachment mechanism positioned on the first side of the headwear, and the second attachment mechanism configured to couple to a fourth attachment mechanism positioned on the second side of the headwear. In a twelfth example, optionally including one or more or each of the first through eleventh examples, the system further comprises: a first positioning panel positioned on the first side of the headwear and a second positioning panel positioned on the second side of the headwear, the first positioning panel positioned adjacent a first slit and the second positioning panel positioned adjacent a second slit, wherein the first slit provides access to the first pocket and the second slit provides access to the second pocket.

The disclosure also provides support for headwear, comprising: a crown including a first pocket and a second pocket, the first pocket positioned on a first side of the crown, the second pocket positioned on a second side of the crown, the first side being opposite the second side, the first pocket and the second pocket each terminating at a rear of the crown, a first cape housed in and deployable from the first pocket, the first cape configured to extend from the first side to the rear of the crown, a second cape housed in and deployable from the second pocket, the second cape configured to extend from the second side to the rear of the crown, and one or more fasteners configured to couple the first cape to the second cape. In a first example, the first pocket and the second pocket each terminate at an opening positioned at the rear of the crown, wherein the first cape and the second cape are configured to extend across the opening at the rear of the crown when the one or more fasteners couple the first cape to the second cape. In a second example, optionally including the first example, the first cape includes a first cape body surrounded by a first terminal cape edge, the first terminal cape edge including a first top edge, the first top edge including a first portion permanently coupled to the first pocket and a second portion comprised of an elastic material.

The disclosure also provides support for headwear, comprising: a crown including at least a front crown panel, a first pocket positioned on a first side of the front crown panel and partially defined by a first outer layer, a second pocket positioned on a second side of the front crown panel and partially defined by a second outer layer, a first cape housed in and deployable from the first pocket, and a second cape housed in and deployable from the second pocket. In a first example of the system, the first cape includes a first top edge, the first top edge including a first portion permanently coupled to the first pocket and a second portion comprised of an elastic material, and wherein the second cape includes a second top edge, the second top edge including a third portion permanently coupled to the second pocket and a fourth portion comprised of the elastic material. In a second example, optionally including the first example, the first pocket is accessible via a first zipper coupled between the first outer layer of the first pocket and a first inner layer of the first pocket, wherein the second pocket is accessible via a second zipper coupled between the second outer layer of the second pocket and a second inner layer of the second pocket, and further comprising a first positioning panel, a second positioning panel, a first slit formed between the first outer layer and the first positioning panel, the first slit providing access to the first pocket, and a second slit formed between the second outer layer and the second positioning panel, the second slit providing access to the second pocket, wherein the first positioning panel is positioned below the first zipper, and wherein the second positioning panel is positioned below the second zipper. In a third example, optionally including one or both of the first and second examples, the headwear further comprises: a brim extending partially around the bottom circumferential edge of the headwear, wherein the brim extends below the first positioning panel and the second positioning panel and terminates at the first pocket and at the second pocket.

It will be understood that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various structures and configurations, and other features, functions, acts, and/or properties disclosed herein, as well as any and all equivalents thereof.

The invention claimed is:

1. Headwear, comprising:

a first pocket positioned on a first side of the headwear and a second pocket positioned on a second side of the headwear, the first side being opposite the second side; and a set of capes comprising a first cape housed in and deployable from the first pocket and a second cape housed in and deployable from the second pocket, wherein the first cape includes a first cape body and a first terminating edge and the second cape includes a second cape body and a second terminating edge, the first terminating edge at least partially surrounding the first cape body, the second terminating edge at least partially surrounding the second cape body, wherein the first terminating edge of the first cape includes a first top edge and the second terminating edge of the second cape includes a second top edge, wherein a first portion of the first top edge and a second portion of the second top edge are coupled to the first pocket and the second pocket, respectively, and a third portion of the first top edge and a fourth portion of the second top edge are not directly coupled to the first pocket or the second pocket, the third portion of the first top edge and the fourth portion of the second top edge being free to move relative to the headwear.

2. The headwear of claim 1, wherein the first cape is configured to extend from the first side to a rear of the headwear and the second cape is configured to extend from the second side to the rear of the headwear.

3. The headwear of claim 2, further comprising one or more fasteners configured to couple the first cape to the second cape.

4. The headwear of claim 3, further comprising a size adjustment mechanism positioned at the rear of the headwear, wherein the size adjustment mechanism and a back edge of each of the first pocket and the second pocket frame an open area at the rear of the headwear, the first pocket terminating at the open area and the second pocket terminating at the open area, and wherein the first cape and the second cape extend across the open area when coupled together via the one or more fasteners.

5. The headwear of claim 4, wherein at least a top of the open area remains open when the first cape and the second cape are deployed.

6. The headwear of claim 3, wherein the first pocket is comprised of a first outer layer and a first inner layer portion, and the second pocket is comprised of a second inner layer portion and a second outer layer.

7. The headwear of claim 6, wherein an inner volume of the first pocket is accessible via a first zipper, and wherein an inner volume of the second pocket is accessible via a second zipper.

8. The headwear of claim 3, wherein the one or more fasteners include a first set of fasteners positioned on the first terminating edge and a second set of fasteners positioned on the second terminating edge.

9. The headwear of claim 8, wherein the third portion of the first top edge and the fourth portion of second top edge are each configured to extend radially around the rear of the headwear when the first cape and the second cape are deployed and held in place via the first set of fasteners and the second set of fasteners.

10. The headwear of claim 1, wherein the first cape includes a first attachment mechanism and the second cape includes a second attachment mechanism, the first attachment mechanism configured to couple to a third attachment mechanism positioned on the first side of the headwear, and the second attachment mechanism configured to couple to a fourth attachment mechanism positioned on the second side of the headwear.

11. The headwear of claim 1, further comprising a first positioning panel positioned on the first side of the headwear and a second positioning panel positioned on the second side of the headwear, the first positioning panel positioned adjacent a first slit and the second positioning panel positioned adjacent a second slit, wherein the first slit provides access to the first pocket and the second slit provides access to the second pocket.

12. Headwear, comprising:

a crown including a first pocket and a second pocket, the first pocket positioned on a first side of the crown, the second pocket positioned on a second side of the crown, the first side being opposite the second side, the first pocket and the second pocket each terminating at a rear of the crown;

a first cape housed in and deployable from the first pocket, the first cape configured to extend from the first side to the rear of the crown;

a second cape housed in and deployable from the second pocket, the second cape configured to extend from the second side to the rear of the crown; and one or more fasteners configured to couple the first cape to the second cape, wherein the first pocket and the second pocket each terminate at an opening positioned at the rear of the crown, and wherein the first cape and the second cape are configured to extend across the opening at the rear of the crown when the one or more fasteners couple the first cape to the second cape.

13. The headwear of claim 12, wherein the first cape includes a first cape body surrounded by a first terminal cape edge, the first terminal cape edge including a first top edge, the first top edge including a first portion permanently coupled to the first pocket and a second portion comprised of an elastic material.

14. Headwear, comprising:

a crown including at least a front crown panel;

a first pocket positioned on a first side of the front crown panel and partially defined by a first outer layer;

a second pocket positioned on a second side of the front crown panel and partially defined by a second outer layer;

a first cape housed in and deployable from the first pocket; and a second cape housed in and deployable from the second pocket, wherein the first cape includes a first top edge, the first top edge including a first portion permanently coupled to the first pocket and a second portion comprised of an elastic material, and wherein the second cape includes a second top edge, the second top edge including a third portion permanently coupled to the second pocket and a fourth portion comprised of the elastic material.

15. The headwear of claim 14, wherein the first pocket is accessible via a first zipper coupled between the first outer layer of the first pocket and a first inner layer of the first pocket, wherein the second pocket is accessible via a second zipper coupled between the second outer layer of the second pocket and a second inner layer of the second pocket, and further comprising a first positioning panel, a second positioning panel, a first slit formed between the first outer layer and the first positioning panel, the first slit providing access to the first pocket, and a second slit formed between the second outer layer and the second positioning panel, the second slit providing access to the second pocket, wherein the first positioning panel is positioned below the first zipper, and wherein the second positioning panel is positioned below the second zipper.

16. The headwear of claim 15, further comprising a brim extending partially around the bottom circumferential edge of the headwear, wherein the brim extends below the first positioning panel and the second positioning panel and terminates at the first pocket and at the second pocket.

* * * * *